US009828991B2

(12) United States Patent
Muramatsu et al.

(10) Patent No.: US 9,828,991 B2
(45) Date of Patent: Nov. 28, 2017

(54) VARIABLE DISPLACEMENT VANE PUMP

(71) Applicant: HITACHI AUTOMOTIVE SYSTEMS STEERING, LTD., Hiki-gun, Saitama (JP)

(72) Inventors: Satoshi Muramatsu, Atsugi (JP); Yutaka Ogiwara, Atsugi (JP); Masaaki Aoki, Atsugi (JP); Norikazu Kumasaka, Atsugi (JP); Yoshiaki Kido, Atsugi (JP)

(73) Assignee: HITACHI AUTOMOTIVE SYSTEMS STEERING, LTD., Saitama (JP)

( * ) Notice: Subject to any disclaimer, the term of this patent is extended or adjusted under 35 U.S.C. 154(b) by 276 days.

(21) Appl. No.: 14/660,195

(22) Filed: Mar. 17, 2015

(65) Prior Publication Data

US 2016/0084249 A1 Mar. 24, 2016

(30) Foreign Application Priority Data

Sep. 22, 2014 (JP) ..... 2014-192258

(51) Int. Cl.

| | |
|---|---|
| ***F01C 20/18*** | (2006.01) |
| ***F04C 2/344*** | (2006.01) |
| ***F04C 14/22*** | (2006.01) |
| ***F04C 15/06*** | (2006.01) |

(52) U.S. Cl.

CPC ..... *F04C 2/344* (2013.01); *F04C 14/226* (2013.01); *F04C 15/06* (2013.01); *F04C 2250/102* (2013.01)

(58) Field of Classification Search

CPC .. F04C 14/226; F04C 15/06; F04C 2250/102; F04C 2/344

USPC ..... 418/23

See application file for complete search history.

(56) References Cited

U.S. PATENT DOCUMENTS 2,433,484 A * 12/1947 Roth ..... F04C 14/226 418/26

FOREIGN PATENT DOCUMENTS

JP 2004-092395 A 3/2004

* cited by examiner

*Primary Examiner* — Mark Laurenzi
*Assistant Examiner* — Anthony Ayala Delgado
(74) *Attorney, Agent, or Firm* — Foley & Lardner LLP

(57) ABSTRACT

A variable displacement vane pump includes a notch portion which is a flow path provided to extend from an initiating end of a discharge port towards a terminating end side of a suction port. The notch portion is formed so that a sectional area of the flow path is smaller than a sectional area of the discharge port at the initiating end thereof and that a length of the flow path in a circumferential direction is 1.5 pitches or larger. The terminating end of the suction port is a point where the vane in the suction area last overlaps the suction port. The initiating end of the discharge port is a point where the vane departed from the suction area first overlaps the discharge port. One pitch is a distance defied in the circumferential direction between adjacent vanes of the plurality of vanes.

20 Claims, 9 Drawing Sheets

VARIABLE DISPLACEMENT VANE PUMP

TECHNICAL FIELD

The present invention relates to a vane pump.

BACKGROUND

Conventionally, vane pumps have been known. For example, the Japanese Patent Application Public Disclosure No. 2004-92395 describes a vane pump in which a notch is provided at an initiating end of a discharge port. When the stroke shifts from a suction stroke to a discharge stroke, a pump chamber first communicates with the notch. In this vane pump, an increase in pressure in the pump chamber is realized by a working fluid which is introduced from a discharge port through the notch.

SUMMARY

However, with those conventional vane pumps, there have been fears that noise is generated.

In a vane pump according to the embodiment of the invention, a length of notch is 1.5 times or more a distance between adjacent vanes.

Consequently, it is possible to restrict the generation of noise.

DESCRIPTION OF EMBODIMENTS

Embodiment 1

Figure 1:
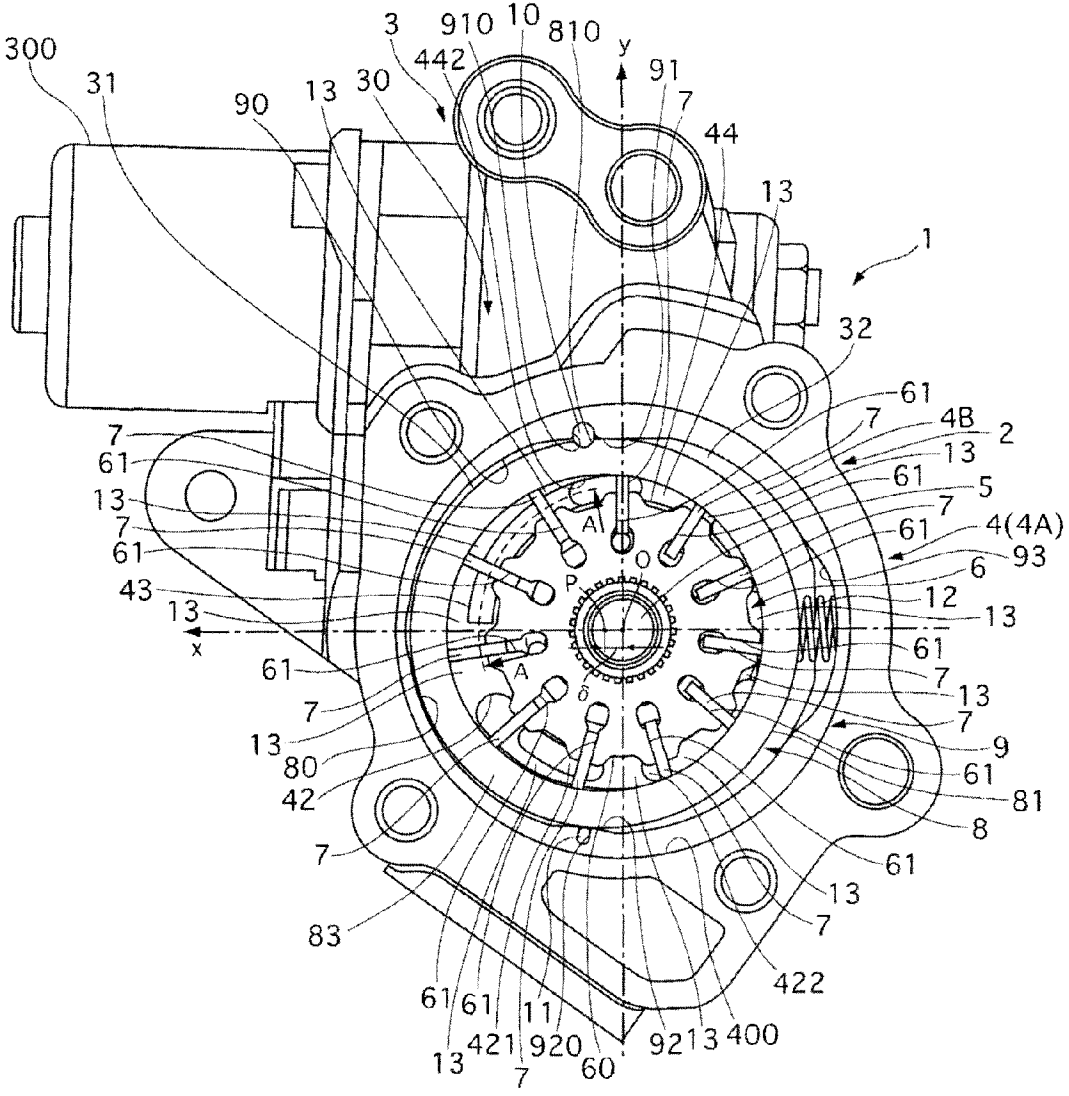
FIG. 1 is a view of an interior of a pump of Embodiment 1 as viewed from an axial direction of the pump.

Firstly, the configuration of a vane pump (hereinafter, referred to as a pump 1) of Embodiment 1 will be described. The pump 1 is used as a hydraulic pressure supply source for a hydraulic actuator mounted on a motor vehicle. Specifically, the pump 1 is used in an automotive automatic transmission. The pump 1 is driven by a crankshaft of an internal combustion engine (an engine) to suck and discharge a hydraulic fluid. A working fluid, more specifically AFT (automatic transmission fluid), is used as the hydraulic fluid. An automatic transmission to which the pump 1 is applied is a continuously variable belt and pulley transmission (hereinafter, referred to CVT). Various valves which are controlled by a CVT control unit are provided within a control valve of the CVT. A working fluid which is discharged from the pump 1 is supplied to various portions (a primary pulley, a secondary pulley, a forward clutch, a reverse brake, a torque converter, a lubricating and cooling system, and the like) of the CVT via the control valve. FIG. 1 is a view of an interior of the pump 1 with a front body 4C removed as viewed from an axial direction of a drive shaft 5. As a matter of convenience in description, a three-dimensional orthogonal coordinates system is provided. An x axis and a y axis are set in radial directions of the drive shaft 5. A z axis is set in an axial direction of the drive shaft 5. The z axis is provided on a shaft center O (a rotational axis of a rotor 6) of the drive shaft 5. The x axis is provided in a direction in which a cam ring 8 oscillates with respect to the shaft center O. The y axis is provided in a direction which intersects the x axis and the z axis at right angles. In FIG. 1, a near side of a sheet of paper on which FIG. 1 is drawn is referred to as a positive direction side. A left side of the sheet of paper is referred to as a positive direction side of the x axis. An upper side of the sheet of paper is referred to as a positive direction side of the y axis.

The pump 1 is of a variable displacement form (a variable displacement type) in which a discharge displacement (a quantity of fluid to be discharged per rotation or a pump displacement) is variable. In the pump 1, a pump module 2 which sucks and discharges the working fluid and a control unit (a cam ring control mechanism 3) for controlling the pump displacement are provided in the same pump housing 4. Namely, the pump 1 is a pump unit into which the pump module 2 and the control unit are integrated. The pump module 2 includes, as main constituent elements (pump elements), a drive shaft 5, a rotor 6, a plurality of vanes 7, a cam ring 8, and an adapter ring 9. The drive shaft 5 is supported rotatably on the pump housing 4 and is driven to rotate by a crankshaft. The rotor 6 is driven to rotate by the drive shaft 5. Hereinafter, a rotating direction of the drive shaft 5 will be referred to as a circumferential direction. The rotor 6 includes a plurality of slots 61 in the circumferential direction. The vanes 7 are plate members which are accommodated in the slots 61 in the rotor 6 so as to project from and sink into (so as to appear from and disappear into) the rotor 6. The cam ring 8 has an annular shape and is disposed so as to surround the rotor 6. The adapter ring 9 has an annular shape and is disposed so as to surround the cam ring 8.

The pump housing 4 includes a rear body 4A, a side plate 4B and a front body 4C. The side plate 4B is a circular disc-shaped member (a pressure plate). The rear body 4A includes a recess portion 400. The recess portion 400 is a bottomed cylindrical shape and extends in the z axis direction to open to a z axis positive side surface of the rear body 4A. A diameter of the recess portion 400 is slightly larger than a diameter of the side plate 4B. The side plate 4B is accommodated in the recess portion 400. A z axis negative side surface of the side plate 4B is brought into contact with a z axis negative side bottom portion of the recess portion 400. A z axis negative side portion of the drive shaft 5 passes through the side plate 4B and is supported rotatably on the rear body 4A. A center of the recess portion 400 coincides approximately with a shaft center O of the drive shaft 5. The front body 4C is disposed on a z axis positive side of the rear body 4A and is fixed to the rear body 4A with a bolt. The front body 4C closes the opening of the recess portion 400. A z axis positive side portion of the drive shaft 5 is supported rotatably on the front body 4C. The drive shaft 5 is accommodated in the recess portion 400 of the rear body 4A. Additionally, the rotor 6, the plurality of vanes 7, the cam ring 8, and the adapter ring 9 are accommodated on a z axis positive side of the side plate 4B in the recess portion 400. Namely, the recess portion 400 functions as a pump elements accommodating portion. A low pressure chamber and a high pressure chamber are provided in an interior of the rear body 4 (this being not shown in the figure). The low pressure chamber is connected to a return fluid line (a fluid suction line) of the working fluid returning from the various portions of the CVT. The high pressure line is connected to the control valve of the CVT via a fluid discharge line.

The adapter ring 9 has the annular shape and is disposed in the recess portion 400 while being positioned in the circumferential direction. A center of the adapter ring 9 coincides approximately with the shaft center O of the drive shaft 5. A first supporting surface 91, a second supporting surface 92 and a spring installation portion 93 are provided on an inner circumference of the adapter ring 9. The first supporting surface 91 has a planar shape which extends in the z axis direction. The first supporting surface 91 is disposed on a y axis positive side of the inner circumference of the adapter ring 9. A first recess portion 910 is provided on the first supporting surface 91. This first recess portion 910 is positioned slightly closer to the positive direction of the x axis with respect to the shaft center O. The first recess portion 910 has a semi-cylindrical shape which extends in the direction of the z axis. The second supporting surface 92 extends in the direction of the z axis and is formed into a curved surface which projects towards the shaft center O. The second supporting surface 92 is disposed on a y axis negative side of the inner circumference of the adapter ring 9. The second supporting surface 92 is positioned slightly closer to the positive direction of the x axis with respect to the shaft center O. A second recess portion 920 is provided which extends in the z axis direction. The spring installation portion 93 is a recess portion which is provided on an x axis negative side of the inner circumference of the adapter ring 9.

The cam ring 8 has the annular shape and is installed on an inner circumferential side of the adapter ring 9 so as to oscillate. Namely, the cam ring 8 is provided so as to move in the recess portion 400 of the rear body 4A. An inner circumferential surface 80 of the cam ring 8 is formed into a cylindrical shape which extends in the z axis direction. Hereinafter, a central axis of the inner circumferential surface 80 will be referred to as a center P of the cam ring 8. A recess portion 810 and a spring installation portion are provided on an outer circumference of the cam ring 80. The recess portion 810 has a semi-cylindrical shape which extends in the z axis direction. The recess portion 810 is disposed on the positive side of the y axis in a position which lies slightly closer to the positive direction of the x axis with respect to the shaft center O so that the recess portion 810 faces the first recess portion 910 on the adapter ring 9 in a radial direction of the cam ring 8. The spring installation portion (not shown) is a bottomed recess portion which opens to an outer circumferential surface 81 of the cam ring 8. This spring installation portion is disposed on a negative side of the x axis so as to face the spring installation portion 93 of the adapter ring 9 in the radial direction of the cam ring 8.

A pin 10, which extends in the z axis direction, is installed between the first recess portion 910 on the adapter ring 9 and the recess portion 810 on the cam ring 8 in such a way as to be held between these recess portions 910, 810. The pin 10 is fixed relative to the pump housing 4 (the rear body 4A and the front body 4C). A seal member 11 is installed in the second recess portion 920 on the adapter ring 9. The seal member 11 is brought into abutment with the outer circumferential surface 81 of the cam ring 8. A coil spring 12, which is an elastic member, is installed between the inner circumference of the adapter ring 9 and the outer circumference of the cam ring 8 in a compressed state. One end of the coil spring 12 is installed in the spring installation portion 93 of the adapter ring 9. The other end of the coil spring 12 is fitted in the spring installation portion of the cam ring 8 for installation. The coil spring 12 biases the cam ring 8 towards the positive side of the x axis relative to the adapter ring 9 at all times.

The cam ring 8 is supported on the adapter ring 9 at the first supporting surface 91. The cam ring 8 is installed so as to oscillate on the first supporting surface 91 as a fulcrum within an xy plane. In so oscillating, the cam ring 8 moves slightly on the first supporting surface 91 in such a way as to roll thereon. As this occurs, the pin 10 restricts a positional deviation (a relative rotation) of the cam ring 8 in the rotating direction thereof relative to the adapter ring 9. The outer circumferential surface 81 of the cam ring 8 is brought into contact with the first supporting surface 91 on a y axis positive side and is brought into sliding contact with the seal member 11 on a y axis negative side. The oscillation of the cam ring 8 is restricted at both the positive and negative sides of the x axis as a result of, for example, the outer circumferential surface 81 being brought into abutment with an inner circumferential surface 90 of the adapter ring 9. An amount of displacement of the center P of the cam ring 8 relative to the shaft center O is referred to as an eccentricity δ. The eccentricity δ becomes the smallest in a position where the outer circumferential surface 81 is brought into abutment with the inner circumferential surface 90 at the negative side of the x axis (a smallest eccentricity position). The eccentricity δ becomes the largest in the position in FIG. 1 where the outer circumferential surface 81 is brought into abutment with the inner circumferential surface 90 at the positive side of the x axis (a largest eccentricity position). A space defined between the inner circumferential surface 90 and the outer circumferential surface 81 is sealed up by the side plate 4B at an opening on the negative side of the z axis. An opening of the space on the positive side of the z axis is sealed up by the front body 4C. The space is divided into two control chambers 31, 32 in a fluid-tight fashion by a contact portion between the first supporting surface 91 and the outer circumferential surface 81 and a contact portion between the seal member 11 and the outer circumferential surface 81. A first control chamber (a first hydraulic chamber) 31 is formed on the positive side of the x axis, and a second control chamber (a second hydraulic chamber) 32 is formed on the negative side of the x axis.

The rotor 6 is fixed to an outer circumference of the drive shaft 5. The rotor 6 has a generally cylindrical shape and is disposed so as to extend in the z axis direction. A dimension of the rotor 6 in the z axis direction is approximately equal to a dimension of the cam ring 8 in the z axis direction. The rotor 6 rotates about the shaft center O in a clockwise direction shown in FIG. 1. The slots 61 are bottomed grooves (slits) and extend in a radial direction of the rotor 6 (a radial direction relative to a rotational axis of the rotor 6) in an interior of the rotor 6 to open to an outer circumferential surface 60 of the rotor 6. The slots 61 are provided so as to extend over a whole range of the rotor 6 in the z axis direction. Proximal end portions of the slots 61 on a radially inward side of the rotor 6 (a side facing the shaft center O) are each formed into an elliptic shape which is larger in diameter than a circumferential width of the slot 61 as viewed from the z axis direction. The slots 61 are provided at approximately equal intervals in the circumferential direction.

Figure 7:
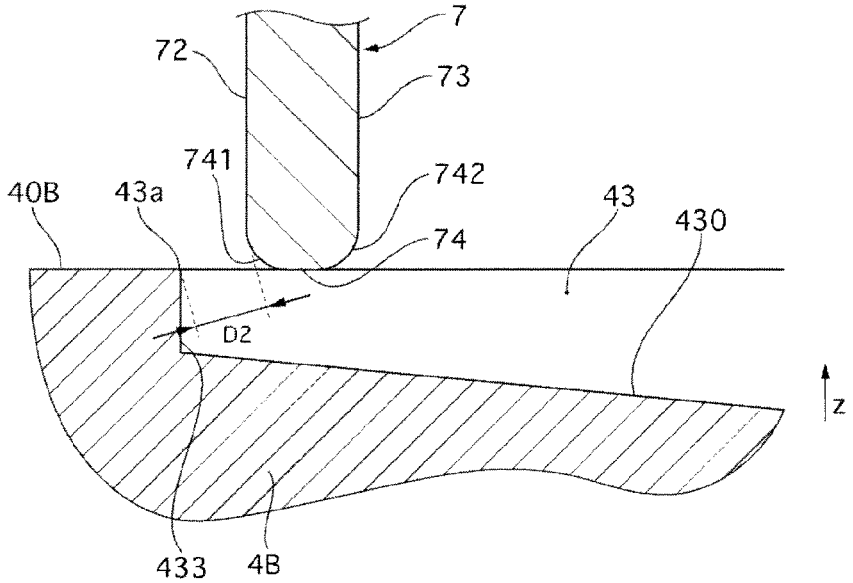
FIG. 7 is a sectional view of the notch portion in the side plate of Embodiment 1 together with part of the vanes resulting from being cut along the circumferential direction.

The plurality of (eleven) vanes 7 are provided. The vanes 7 are accommodated individually in the corresponding slots 61 so as to appear from and disappear into the slots 61. The numbers of slots 61 and vanes 11 are not limited to 11. A dimension of the vane 7 in the z axis direction is approximately equal to the dimension of the rotor 6 (the slots 61) in the z axis direction. A back pressure chamber (a pressure bearing portion) of the vane 7 is formed between the proximal end portion (on the side facing the shaft center O) of the slot 61 and a surface 70 of the vane 7 at a proximal end side (a side facing the proximal end portion of the slot 61) thereof. Both end portions of the vane 7 in the z axis direction are formed into a rounded shape by rounding corners thereof. As shown in FIG. 7, at the end portion of the vane 7 on the negative side of the z axis, a surface 72 on one circumferential side (a side facing a reverse rotating direction of the rotor 6) continues smoothly to a surface 74 at the negative side of the z axis via a curved surface 741. The curved surface 741 has an arc-like shape which projects towards the reverse rotating direction of the rotor 6 and the negative side of the z axis as viewed from the radial direction of the rotor 6. A surface 73 on the other circumferential side (a side facing a (forward) rotating direction of the rotor 6) continues smoothly to the surface 74 at the negative side of the z axis via a curved surface 742. The curved surface 742 has an arc-like shape which projects towards the (forward) rotating direction of the rotor 6 and the negative side of the z axis as viewed from the radial direction of the rotor 6. At the end portion of the vane 7 on the negative side of the z axis, a circumferential thickness of the vane 7 decreases gradually towards the z axis negative direction. At the end portion of the vane 7 on the positive side of the z axis is also formed into a similar rounded shape to that of the end portion on the negative side of the z axis.

The side plate 4B (a surface 40B lying on the positive side of the z axis) is disposed so as to face a surface 82 of the cam ring 8 which lies on the negative side of the z axis, a surface of the rotor 6 which lies on the negative side of the z axis and the surfaces 74 of the vanes 7 which lie on the negative side of the z axis. The front body 4C (a surface 40C lying on the negative side of the z axis) is disposed so as to face a surface 83 of the cam ring 8 which lies on the positive side of the z axis, a surface of the rotor 6 which lies on the positive side of the z axis and surfaces 75 of the vanes 7 which lie on the positive side of the z axis. A distance between the surface 40B of the side plate 4B which lies on the positive side of the z axis and the surface 40C of the front body 4C which lies on the negative side of the z axis is slightly larger than the dimensions of the cam ring 8, the rotor 6 and the vanes 7 in the z axis direction. An annular space is defined by the outer circumferential surface 60 of the rotor 6, the inner circumferential surface 80 of the cam ring 8, the surface 40B of the side plate 4B and the surface 40C of the front body 4C therebetween. This annular space is divided into a plurality of (eleven) pump chambers (vane chambers) 13 by the vanes 7. In other words, the cam ring 8 defines the plurality of pump chambers 13 on an inner circumferential side thereof together with the rotor 6 and the vanes 7. Hereinafter, a circumferential distance of the vanes 7 which lie adjacent to each other in the circumferential direction (which corresponds to an angle formed by the circumferentially adjacent vanes 7) will be referred to as one pitch. When referred to herein, the circumferential distance between any two circumferentially adjacent vanes 7 is a distance between a surface on one side in the circumferential direction (for example, the surface 72 which lies to face the reverse rotating direction of the rotor 6) of one vane 7 and the surface (72), on one side in the circumferential direction, of the other vane 7 circumferentially adjacent to the one vane 7. Alternatively, the circumferential distance is a distance between a circumferential center of the one vane 7 and a circumferential center of the other vane 7 circumferentially adjacent to the one vane 7. A circumferential dimension of one pump chamber 13 is slightly smaller than one pitch (a dimension resulting from subtracting the circumferential dimension of the vane 7 from one pitch).

With the cam ring 8 (the center P) deviating towards the positive side of the x axis relative to the rotor 6 (the shaft center O), a distance in a radial direction of the rotor 6 between the outer circumferential surface 60 of the rotor 6 and the inner circumferential surface 80 of the cam ring 8 (a radial dimension of the pump chamber 13) increases as the rotor 6 extends from the negative side of the x axis towards the positive side of the x axis. The individual pump chambers 13 are defined as a result of the vanes 7 appearing from and disappearing into the slots 61. Displacements of the pump chambers 13 on the positive side of the x axis are larger than displacements of the pump chambers 13 on the negative side of the x axis. Due to the different displacements of the pump chambers 13, on the negative side of the y axis with respect to the shaft center O, the displacements of the pump chambers 13 increase as the pump chambers 13 are located towards the positive side of the x axis which is the rotating direction (the clockwise direction in FIG. 1) of the rotor. On the other hand, on the positive side of the y axis with respect to the shaft center O, the displacements of the pump chambers 13 decrease as the pump chambers 13 are located towards the negative side of the x axis which is the rotating direction of the rotor 6. A segment on the negative side of the y axis where the displacements of the pump chambers 13 increase as the rotor 6 rotates is a suction area.

A segment on the positive side of the y axis where the displacements of the pump chambers 13 decrease as the rotor 6 rotates is a discharge area.

Figure 2:
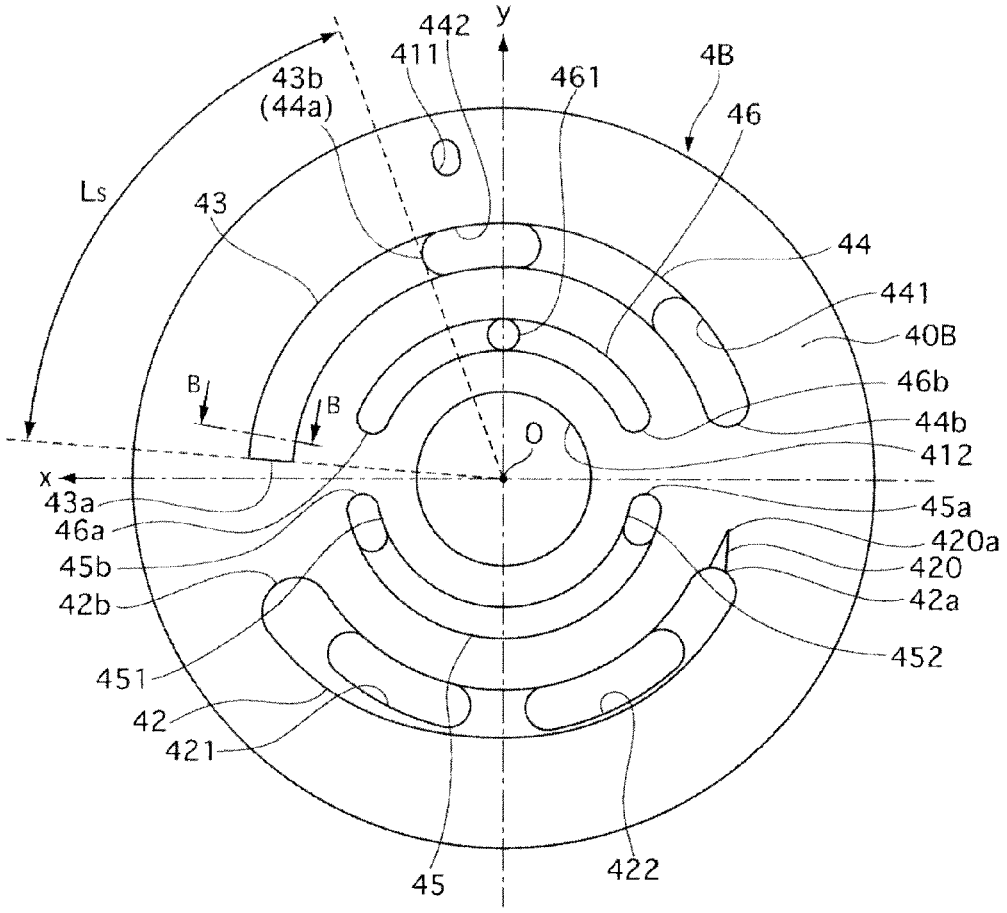
FIG. 2 is a front view of a side plate of Embodiment 1.

FIG. 2 is a front view of the side plate 4B as viewed from the positive side of the z axis. On the side plate 4B, a hole 411 through which the pin 10 pass and a hole 412 through which the drive shaft 5 pass are formed. As a result of the pin 10 passing through the hole 411 to be fixed to the rear body 4A, a circumferential position of the side plate 4B in the recess portion 400 is determined. On the surface 40B of the side plate 4B which faces the positive side of the z axis, a suction port 42, a notch portion 43, a discharge port 44, a suction side back pressure port 45 and a discharge side back pressure port 46 are formed.

The suction port (an inlet port) 42 is a bottomed recess portion (a groove) which opens to part of the suction area and is an inlet when the working fluid is introduced from the CVT into the pump chambers 13 on a suction side. The suction port 42 is formed into a generally arc shape which is centered at the shaft center O in a position where it overlaps the pump chambers 13 on the suction side as viewed from the z axis direction. An end portion of the suction port 42 which faces the reverse rotating direction of the rotor 6 is an initiating end 42*a* of the suction port 42. The initiating end 42*a* is a point where the vanes 7 on the suction area come first to overlap the suction port 42. An end portion of the suction port 42 which faces the (forward) rotating direction of the rotor 6 is a terminating end 42*b* of the suction port 42. The terminating end 42*b* is a point where the vanes 7 on the suction area come last to overlap the suction port 42. Both the initiating end 42*a* and the terminating end 42*b* of the suction port 42 are provided in an interior of the suction area (the negative side of the y axis with respect to the shaft center O). A distance in the reverse rotating direction of the rotor 6 from the initiating end 42*a* of the suction port 42 to the discharge area (the positive side of the y axis with respect to the shaft center O) and a distance in the (forward) rotating direction of the rotor 6 from the terminating end 42*b* of the suction port 42 to the discharge area are both smaller than one pitch. A suction hole 421 and a communication hole 422 open to a bottom portion of the suction port 42. Both the holes 421, 422 penetrate the side plate 4B. The suction hole 421 is formed at a terminating end 42*b* side of the suction port 42. The communication hole 422 is provided at an initiating end 42*a* side of the suction port 42. A notch portion 420 is provided at the initiating end 42*a* of the suction port 42 so as to extend in the circumferential direction towards the reverse rotating direction of the rotor 6. A dimension of the notch portion 420 in the radial direction of the rotor 6 (a widthwise dimension) is smaller than a dimension of the suction port 42 in the radial direction of the rotor 6 (a widthwise dimension) and gradually decreases as it extends towards the reverse rotating direction of the rotor 6. An end portion (an initiating end 420*a*) of the notch portion 420 in the reverse rotating direction of the rotor 6 is provided on the negative side of the y axis (the suction area) with respect to the shaft center O.

The discharge port (an outlet port) 44 is a bottomed recess portion (a groove) which opens to part of the discharge area and is an outlet when the working fluid is discharged to the CVT from the pump chambers 13 on a discharge side. The discharge port 44 is formed into a generally arc shape which is centered at the shaft center O in a position where it overlaps the pump chambers 13 on the discharge side as viewed from the z axis direction. An end portion of the discharge port 44 which faces the reverse rotating direction of the rotor 6 is an initiating end 44*a* of the discharge port 44. The initiating end 44*a* is a point where the vanes 7 on the discharge area come first to overlap the discharge port 44. An end portion of the discharge port 44 which faces the (forward) rotating direction of the rotor 6 is a terminating end 44*b* of the discharge port 44. The terminating end 44*b* is a point where the vanes 7 on the discharge area come last to overlap the discharge port 44. Both the initiating end 44*a* and the terminating end 44*b* of the discharge port 44 are provided in an interior of the discharge area (the positive side of the y axis with respect to the shaft center O). A distance in the reverse rotating direction of the rotor 6 from the initiating end 44*a* of the discharge port 44 to the suction area (the negative side of the y axis with respect to the shaft center O) is two pitches or larger. A distance in the (forward) rotating direction of the rotor 6 from the terminating end 44*b* of the discharge port 44 to the suction area is smaller than one pitch. A discharge hole 441 and a communication hole 442 open to a bottom portion of the discharge port 44. Both the holes 441, 442 penetrate the side plate 4B to communicate with the high pressure chamber in the rear body 4A. The discharge hole 441 is provided at a terminating end 44*b* side of the discharge port 44 so as to continue to the terminating end 44*b*. The communication hole 442 is provided at an initiating end 44*a* side of the discharge port 44 so as to continue to the initiating end 44*a* in a circumferential position which overlaps the y axis.

Figure 3:
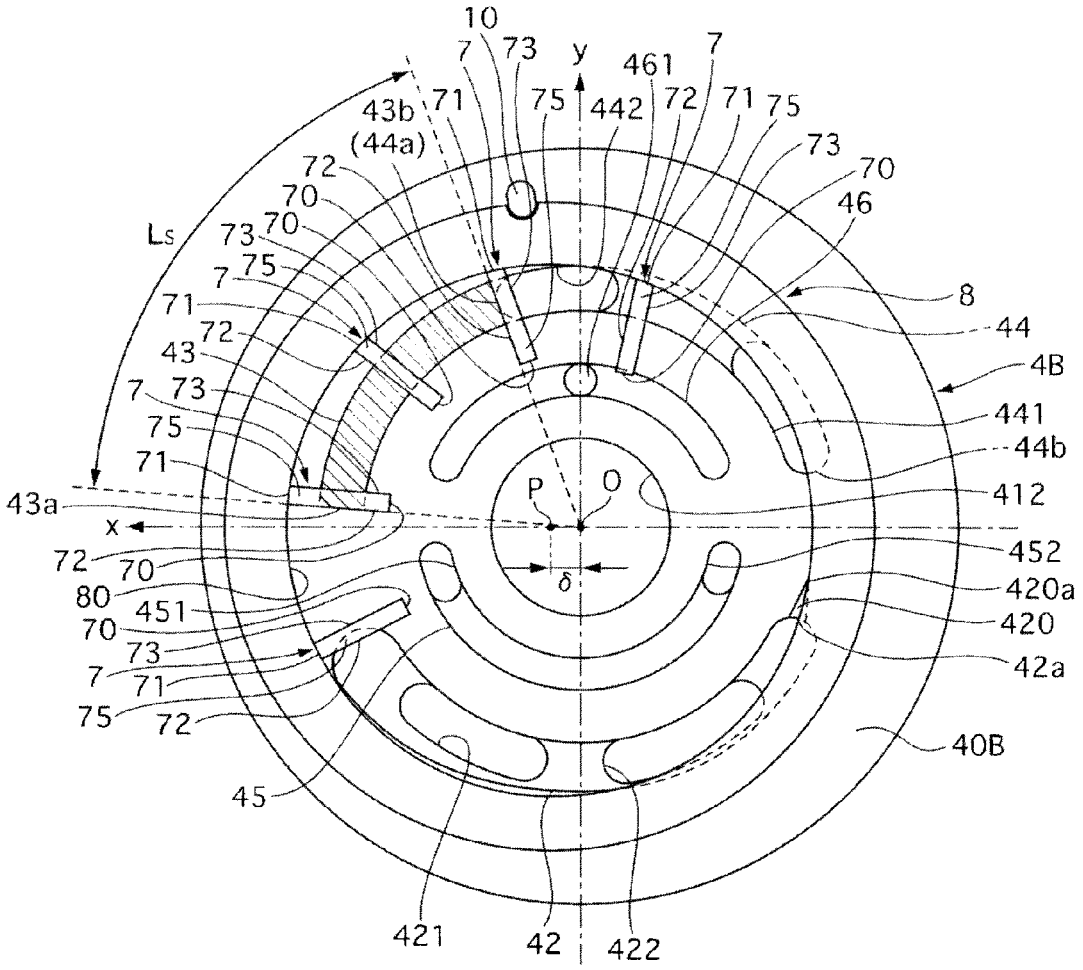
FIG. 3 is a front view of the side plate of Embodiment 1 showing a state in which a cam ring and part of vanes are mounted on the side plate (a state in which an eccentricity of the cam ring is the largest).
Figure 4:
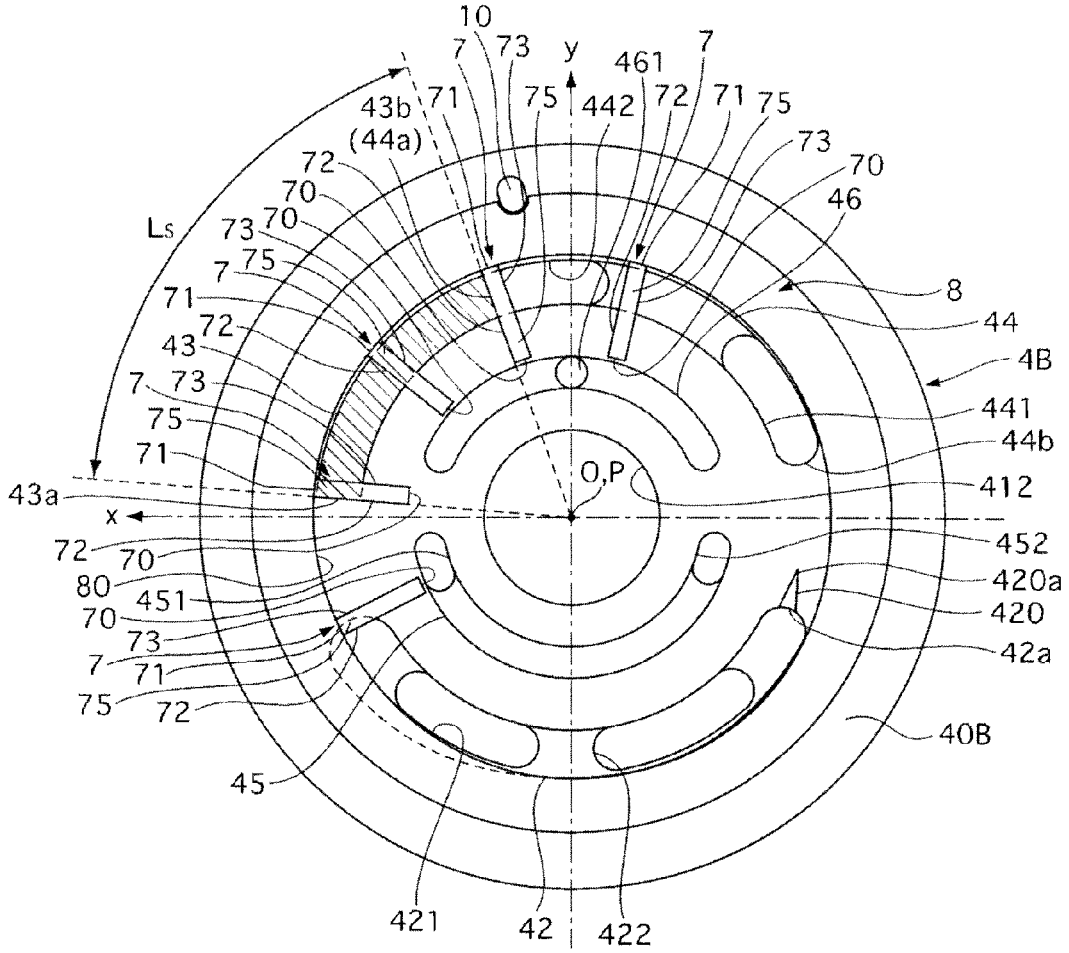
FIG. 4 is a front view showing a state in which the cam ring and part of the vanes are mounted on the side plate of Embodiment 1 (a state in which the eccentricity of the cam ring is the smallest).
Figure 5:
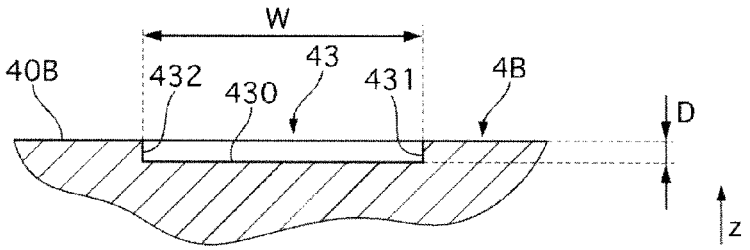
FIG. 5 is a sectional view of a notch portion in the side plate of Embodiment 1 resulting from being sectioned along a radial direction of a rotor (a section taken along a line B-B in FIG. 2).
Figure 6:
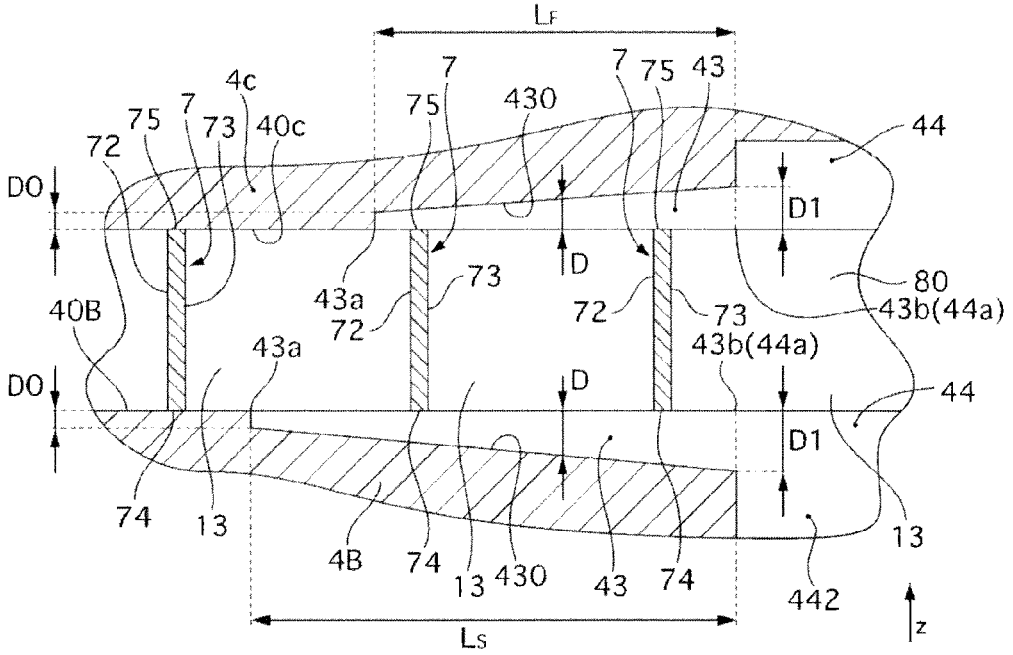
FIG. 6 is a sectional view of the notch portion in the side plate and a notch portion in a front body of Embodiment 1 together with part of the vanes resulting from being sectioned a circumferential direction of the rotor (corresponding to a section taken along a line A-A in FIG. 1).

The notch portion 43 is provided at the initiating end 44*a* of the discharge port 44 so as to extend in the circumferential direction towards the reverse rotating direction of the rotor 6. The notch portion 43 is a flow path which is provided so as to extend from the initiating end 44*a* of the discharge port 44 towards the terminating end 42*b* of the suction port 42 and is formed through machining. FIGS. 3 and 4 are views showing a state in which the cam ring 8 and part of the vanes 7 are mounted on the side plate 4B as viewed from the positive side of the z axis. Shaded portions denote the notch portion 43. FIGS. 3 and 4 show positional relationships between the part of the vanes 7 and the suction port 42, the notch portion 43 and the discharge port 44. In FIG. 3, an eccentric amount or eccentricity δ is the largest, and in FIG. 4, the eccentricity δ is the smallest. FIG. 5 is a sectional view of a portion of the side plate 4B where the notch portion 43 is formed taken along a plane which extends in the radial direction of the rotor 6 (a section taken along a line B-B in FIG. 2). FIG. 6 is a sectional view of portions of the side plate 4B and the front body 4C where the notch portion 43 is formed taken along a plane which extends in the circumferential direction (corresponding to a section taken along a line A-A in FIG. 1). FIG. 7 is a similar sectional view to FIG. 6 but in the figure the front body 4C is omitted. A section of the z axis negative side end portion of one of the vanes 7 mounted on the side plate 4B is also shown.

An end portion of the notch portion 43 which lies to face the reverse rotating direction of the rotor 6 (an end portion facing the terminating end 42*b* of the suction port 42) is an initiating end 43*a* of the notch portion 43. The initiating end 43*a* is provided on the positive side of the y axis with respect to the shaft center O (the discharge area). An end portion of the notch portion 43 which lies to face the (forward) rotating direction of the rotor 6 (an end portion facing the initiating end 44*a* of the discharge port 44) is a terminating end 43*b* of the notch portion 43. The terminating end 43*b* coincides with the initiating end 44*a* of the discharge port 44 and continues to the communication hole 442. The notch portion 43 is formed so that a circumferential dimension (a circumferential length LS) of the notch portion 43 is 1.5 pitches or larger and smaller than 2.5 pitches. Specifically, the LS is approximately two pitches. As shown in FIGS. 3 and 4, regardless of magnitude of the eccentricity δ, the LS remains approximately two pitches (1.5 pitches or larger and smaller than 2.5 pitches). A dimension of the notch portion 43 in the radial direction of the rotor 6 is approximately equal to a dimension of the discharge port 44 in the radial direction of the rotor 6 (a widthwise dimension of the discharge port 44). As shown in FIG. 5, a sectional shape of the notch portion 43 is a flat rectangular shape in any circumferential position of the notch portion 43. Namely, as wall surfaces which make up the notch portion 43, the notch portion 43 includes a flat surface (a bottom surface) 430 on the negative side of the z axis, an arc-shaped curved surface (a lateral surface) 431 on a radially outer side of the rotor 6, and an arc-shaped curved surface (a lateral surface) 432 on a radially inner side of the rotor 6. A dimension of the notch portion 43 in the radial direction of the rotor 6 (a distance between the surfaces 431 and 432, that is, a widthwise dimension W) is larger than a dimension of the notch portion 43 in the z axis direction (a distance between the surfaces 40B and 430B, that is, a depth-wise dimension D) in any circumferential position. The notch portion 43 is formed through machining so that a depth-wise dimension D0 at the initiating end 43*a* thereof is preferably 0.06 mm or smaller.

A sectional area S of the notch portion 43 when sectioned along a plane which extends in the radial direction of the rotor 6 is obtained generally from S=D×W. A sectional area S of the notch portion 43 in an any circumferential direction is smaller than a sectional area resulting from cutting the initiating end 44*a* side of the discharge port 44 along a plane which extends along the radial direction of the rotor 6. Here, as in the case of this embodiment, in the event that the communication hole 442 is provided so as to continue to the initiating end 44*a* of the discharge port, the sectional area at the initiating end 44*a* side of the discharge port 44 is calculated based on a initiating end 44*a* side bottom surface (a plane facing the negative side of the z axis) of the discharge port 44 when assuming that the communication hole 442 is not provided. For example, the sectional area at the initiating end 44*a* side of the discharge port 44 can be calculated by assuming that a distance in the z axis direction between a portion of the bottom surface at the initiating end 44*a* side of the discharge port 44 where the communication hole 442 is not opened and the surface 40B is a depth dimension at the initiating end 44*a* side of the discharge port 44. The widthwise dimension W of the notch portion 43 is constant in any circumferential position. On the other hand, as shown in FIG. 6, a depth dimension D (=D1) at the terminating end 43*b* is larger than a depth dimension D (=D0) at the initiating end 43*a* (D0<D1). In the circumferential direction, the depth dimension D is larger at the terminating end 43*b* side than at the initiating end 43*a* side of the notch portion 43. The D gradually increases as the notch portion 43 extends from the initiating end 43*a* side towards the terminating end 43*b* side of the notch portion 43 (progressively increases from the initiating end 43*a* side towards the terminating end 43*b* side). Consequently, a sectional area S (=S1) at the terminating end 43*b* is larger than a sectional area S (=S0) at the initiating end 43*a* (S0<S1). In the circumferential direction, the sectional area S becomes larger at the terminating end 43*b* side than the initiating end 43*a* side. The S increases gradually as the notch portion 43 extends from the initiating end 43*a* side towards the terminating end 43*b* side thereof (progressively increases from the initiating end 43*a* side towards the terminating end 43*b* side).

Returning to FIG. 2, other configurations of the side plate 4B will be described. Neither recess portion (groove) nor hole is provided between the terminating end 42*b* of the suction port 42 and the initiating end 43*a* of the notch portion 43, and a first confinement area is provided over an angular range which corresponds to the section. Similarly, a second confinement area is provided between the terminating end 44*b* of the discharge port 44 and the initiating end 420*a* of the notch portion 420. The angular ranges of the first and second confinement areas correspond to slightly smaller than one pitch, respectively. The first confinement area and the second confinement area confine therein the working fluid in the pump chambers 13 which stay in these areas to thereby restrict the discharge port 44 (including the notch portion 43) and the suction port 42 (including the notch portion 420) from communicating with each other. The back pressure ports 45, 46 are bottomed recess portions (grooves) and communicate with roots of the vanes 7 (back pressure chambers or the proximal end portions of the slots 61 in the rotor 6). The back pressure ports 45, 46 are formed into generally arc shapes which are centered at the shaft center O along the arrangement of the proximal end portions of the slots 61. The back pressure ports 45, 46 are provided separately from each other on the suction side and the discharge side.

An end portion of the suction side back pressure port 45 which lies to face the reverse rotating direction of the rotor 6 (an initiating end 45*a* of the suction side back pressure port 45) is positioned closer to the negative side of the y axis with respect to the shaft center O and within the angular range of the second confinement area. An end portion of the suction side back pressure port 45 which lies to face the (forward) rotating direction of the rotor 6 (a terminating end 45*b* of the suction side backpressure port 45) is positioned closer to the negative side of the y axis with respect to the shaft center O and within the angular range of the first confinement area. The suction side back pressure port 45 communicates with back pressure chambers of the vanes 7 which are positioned in most of the suction area. Communication holes 451, 452 are opened to a bottom portion of the suction side back pressure port 45. The communication holes 451, 452 penetrate the side plate 4B. The communication hole 451 is provided at a terminating end 45*b* side of the suction side back pressure port 45 so as to continue to the terminating end 45*b*. The communication hole 452 is provided at an initiating end 45*a* side of the suction side back pressure port 45 so as to continue to the initiating end 45*a*. The communication hole 451 is connected to the suction hole 421 of the suction port 42 via a communication path provided in the rear body 4A (a surface of the recess portion 400 which lies to face the positive side of the z axis) or the low pressure chamber in the rear body 4A. The communication hole 452 is connected to the communication hole 422 of the suction port 42 via a communication path provided in the rear body 4A (a surface of the recess portion 400 which lies to face the positive side of the z axis). Namely, the suction side back pressure port 45 communicates with the suction port 42 and the low pressure chamber via the communication holes 451, 452. In the suction area, the working fluid is supplied from the low pressure chamber via the suction side back pressure port 45 to root sides (back pressure chambers) of the vanes 7 which are projecting from the slots 61 as the rotor 6 rotates. As this occurs, the pressure of the suction port 42 (the hydraulic pressure or sucking pressure of the suction side of the pump 1), that is, the same pressure as a pressure acting on distal end sides of the vanes 7 (outer surfaces 71 of the vanes 7 in the radial direction of the rotor 6) acts on the root sides of the vanes 7 (inner surfaces 70 of the vanes 7 in the radial direction of the rotor 6).

An end portion of the discharge side back pressure port 46 which lies to face the reverse rotating direction of the rotor 6 (an initiating end 46*a* of the discharge side back pressure port 46) is positioned closer to the positive side of the y axis with respect to the shaft center O and within the angular range of the notch portion 43. An end portion of the discharge side back pressure port 46 which lies to face the (forward) rotating direction of the rotor 6 (a terminating end 46*b* of the discharge side backpressure port 46) is positioned closer to the positive side of the y axis with respect to the shaft center O and within the angular range of the discharge port 44. The discharge side back pressure port 46 communicates with the back pressure chambers of the vanes 7 which are positioned in most of the discharge area. A communication hole 461 is opened to a bottom portion of the discharge side back pressure port 46. The communication hole 461 penetrates the side plate 4B. The communication hole 461 is provided in an approximately circumferential middle position of the discharge side back pressure port 46 (a circumferential position which overlaps the communication hole 442 of the discharge port 44 in the radial direction of the rotor 6). The communication hole 461 is connected to the communication hole 442 of the discharge port 44 via a communication path provided in the rear body 4A (a surface of the recess portion 400 which lies to face the positive side of the z axis). Namely, the discharge side back pressure port 46 communicates with the discharge port 44 and the high pressure chamber via the communication hole 461. In the discharge area, the working fluid is discharged from the root sides (back pressure chambers) of the vanes 7 which are sinking into the slots 61 as the rotor 6 rotates to the high pressure chamber via the discharge side back pressure port 46. As this occurs, the pressure of the discharge port 44 (the hydraulic pressure or discharging pressure on the discharge side of the pump 1), that is, the same pressure as a pressure acting on distal end sides of the vanes 7 acts on the root sides of the vanes 7.

Similar ports 42 and the like are also formed on the surface 40C of the front body 4C which lies to face the negative side of the z axis in such a way as to correspond to the ports 42 and the like on the rear body 4A. On the front body 4C, holes corresponding to the holes 421 and the like can be omitted. Additionally, as shown in FIG. 6, a notch portion 43 is also formed on the surface 40C of the front body 4C which lies on the negative side of the z axis. Namely, the pair of notch portions 43 is provided so as to face each other in the direction of the z axis (the rotational axis of the rotor 6) with the pump chambers 13 held therebetween. A terminating end 43*b* of the notch portion 43 of the front body 4C and the terminating end 43*b* of the notch portion 43 of the side plate 4B almost overlap each other in the direction of the z axis. An outer edge, in the radial direction of the rotor, of the notch portion 43 of the front body 4C and an outer edge, in the radial direction of the rotor, of the notch portion 43 of the side plate 4B almost overlap each other in the direction of the z axis. An inner edge, in the radial direction of the rotor, of the notch portion 43 of the front body 4C and an inner edge, in the radial direction of the rotor, of the notch portion 43 of the side plate 4B almost overlap each other in the direction of the z axis. On the other hand, the notch portion 43 of the front body 4C is formed to have a different circumferential length from that of the notch portion 43 of the side plate 4B. Specifically, a circumferential length LF of the notch portion 43 of the front body 4C is approximately 1.5 pitches, regardless of the magnitude of the eccentricity δ. Namely, the notch portion 43 of the front body 4C is formed so that the LF is also 1.5 pitches or larger and smaller than 2.5 pitches, regardless of the magnitude of the eccentricity δ. Additionally, a depth-wise dimension D0 at an initiating end 43*a* of the notch portion 43 of the front body 4C is also preferably 0.06 mm or smaller. On the other hand, a depth-wise dimension D1 at the terminating end 43*b* of the notch portion 43 of the front body 4C may differ from the D1 of the notch portion 43 of the side plate 4B. Other characteristics of the notch portion 43 of the front body 4C such as its shape, size, position, and range are similar to those of the notch portion 43 of the side plate 4B.

When the rotor 6 rotates in such a state that the cam ring 8 (the center P) deviates in the positive direction of the x axis with respect to the rotor 6 (the shaft center O), the displacements of the pump chambers 13 are increased and decreased periodically in a repeated fashion while rotating about the shaft center O. The pump chambers 13 which communicate with the suction port 42 suck in the working fluid from the suction port 42 in the suction area where the displacements of the pump chambers 13 are increased. The pump chambers 13 which communicate with the discharge port 44 discharge the working fluid to the discharge port 44 in the discharge area where the displacements of the pump chambers 13 are decreased. In the first and second confinement areas, the pump chambers 13 communicate with neither the suction port 42 (the notch portion 420) nor the discharge port 44 (the notch portion 43), and hence, fluid-tight conditions are maintained in those confinement areas. In this embodiment, since the ranges of the first and second confinement areas are set to be slightly smaller than one pitch, it is possible to improve the pumping efficiency while restricting the pump chambers 13 from communicating with the suction port 42 and the discharge port 44 in those areas. Note that the confinement areas may be provided over a range equal to or larger than one pitch. Additionally, the sucking pressure acts on the back pressure chambers of the vanes 7 via the suction side back pressure port 45 in the suction area, and in the discharge area, the discharging pressure acts on the back pressure chambers of the vanes 7 via the discharge side back pressure port 46. This improves the projecting characteristic of the vanes 7 when the rotational speed of the pump is slow or the like, whereby not only the fluid tightness of the pump chambers 13 is improved, but also the frictional resistance between the vanes 7 and the inner circumferential surface 80 of the cam ring 8 (the torque for driving the pump 1) can be decreased to save the power (improve the fuel economy, for example).

The cam ring control mechanism 3 controls the eccentricity δ of the cam ring 8. The cam ring control mechanism 3 is provided in the rear body 4A and includes a control valve 30, and the first and second control chambers 31, 32. The control valve 30 is a spool valve which controls the flowing of the working fluid into and from the first control chamber 31 and the second control chamber 32. The control valve 30 includes a spool (not shown) as a valve element which switches flow paths, a spring (not shown) as an elastic member which biases the spool in one of its axial directions, and a solenoid 300 which biases the spool in the other of the axial directions. The spool and the spring are installed in an accommodating hole formed in an interior of the rear body 4A. A discharging pressure at a downstream side of a metering orifice and a discharging pressure at an upstream side of the metering orifice, which are supplied from the high pressure chamber (the discharge port 44), act on the spool. A difference in these two pressures (hereinafter, referred to as a differential pressure) generates a pressure which biases the spool in the other of the axial directions. When the biasing force based on this differential pressure exceeds the biasing force of the spring, the spool is caused to stroke in the other of the axial directions. This allows the first control chamber 31 to communicate with the high pressure chamber (the discharge port 44), and the communication between the second control chamber 32 with the high pressure chamber (the discharge port 44) is cut off. When the force with which the cam ring 8 is biased by the pressure supplied into the first control chamber 31 exceeds a total of the force with which the cam ring 8 is biased by the pressure supplied into the second control chamber 32 and the force with which the cam ring 8 is biased by the spring 12, the cam ring 8 oscillates towards the negative side of the x axis, whereby the eccentricity δ is decreased. On the other hand, when the biasing force based on the differential pressure acting on the spool is lower than the biasing force of the spring which acts on the spool, the spool is caused to stroke in the one of the axial directions. This cuts off the communication between the first control chamber 31 and the high pressure chamber (the discharge port 44), and a communication is reestablished between the second control chamber 32 and the high pressure chamber (the discharge port 44). Thus, the cam ring 8 oscillates towards the positive side of the x axis by means of a similar mechanism to the mechanism described above, the eccentricity δ being thereby increased.

The differential pressure acting on the spool increases as the rotational speed (the discharge flow rate) of the pump 1 increases. Consequently, the spool is caused to stroke in the other of the axial directions, whereby the discharging pressure is supplied to the first control chamber 31. This decreases the eccentricity δ, decreasing, in turn, the displacement of the pump. As a result of the control valve 30 operating in this way, the displacement of the pump is controlled so as to change with the discharging flow rate of the pump 1. When the eccentricity δ decreases to some extent, even in the event that the rotational speed of the pump increases, the discharging flow rate of the pump is not increased (the discharging flow rate is maintained constant). In the event that the discharging flow rate decreases excessively, since the differential pressure becomes small, the cam ring 8 deviates again, and an increase in discharging flow rate is realized as required. Being energized as required by the CVT control unit, the solenoid 300 generates an electromagnetic force which biases the spool in the other of the axial directions. This provides the same effect as one provided by decreasing the force with which the spring biases the spool (the set load). Thus, the spool strokes in the other of the axial directions from a point in time when the discharging flow rate is relatively small and the differential pressure is relatively small. This provides a characteristic in which a small flow rate is achieved by the rotational speed of the pump which is slower than when the solenoid 300 is de-energized, and thereafter the resulting flow rate is maintained. It is possible to improve the energy efficiency by controlling the flow rate characteristic in the way described above. The working fluid discharged from the pump 1 is used in the CVT. The CVT control unit controls as required the line pressure according to the driving conditions such as accelerator pedal position, engine revolution speed, and vehicle speed. Thus, for example, when a certain driving condition requires a high discharging flow rate, the electric current (electromagnetic force) with which the solenoid 300 is energized is decreased to a low level or zero, whereas when a certain driving condition requires a low discharging flow rate, the electric current (electromagnetic force) with which the solenoid 300 is energized is increased to a high level.

Next, the operation will be described. The circumferential length LS of the notch portion 43 formed on the side plate 4B is 1.5 pitches or larger. This can restrict the generation of cavitation noise even under operating conditions where air (air bubbles) is mixed into the pump chambers 13 (the quantity of air is large). Namely, the pump 1 is used in the automatic transmission (CVT) as the environment where it is used. Because of this, depending on the operating conditions, much air may be contained in the working fluid (the air content becomes high). Additionally, the air contained state is not stabilized (the air content changes largely). When a certain pump chamber 13 in the pump 1 shifts from the suction area to the discharge area to communicate with the discharge port 44, in case air is contained in the working fluid in the pump chamber 13, the air is collapsed quickly by a high pressure in the discharge port 44 which is supplied into the pump chamber 13. This may generate cavitation noise (abnormal noise resulting from generation of cavitation). With the conventional vane pump in which the notch portion is provided at the initiating end portion of the discharge port, the pump chamber comes to communicate with the notch portion before the pump chamber reaches the discharge port. As this occurs, the highly pressurized working fluid from the discharge port passes through a gap between (the lateral surface of) the rotor rotating direction side vane which makes up the pump chamber and (the wall surface of) the notch portion and is then introduced into the pump chamber (in other words, the working fluid reverses into the pump chamber). In this way, air in the pump chamber is compressed by the pressure of the working fluid introduced into the pump chamber. With the conventional vane pump, however, the circumferential length of the notch portion is not more than about one pitch. This shortens the time during which the pump chamber reaches the discharge port while communicating with the notch portion. Consequently, depending upon the operating conditions, air in the pump chamber cannot be dissolved into the working fluid sufficiently by the pressure introduced in the way described above. Consequently, when the pump chamber reaches the discharge port whereby the discharge port opens to the interior of the pump chamber, there are fears that air remaining in the pump chamber is collapsed quickly to thereby generate cavitation noise.

In contrast with this, with the pump 1 of this embodiment, the circumferential length LS of the notch portion 43 is 1.5 pitches or larger. This extends the time during which the pump chamber 13 reaches the discharge port 44 while communicating with the notch portion 43, that is, the time during which the working fluid is introduced from the discharge port 44 where the pressure is high into the pump chamber 13 via the notch portion 43. Consequently, it is possible to secure enough time for air contained in the working fluid in the pump chamber 13 to be collapsed (dissolved) by the working fluid so introduced. In other words, the pressure in the pump chamber 13 can be raised sufficiently to collapse (dissolve) air in the working fluid therein by the time when the pump chamber 13 reaches the discharge port 44. Consequently, even under the operating conditions where air is mixed into the pump chamber 13 (much air is present in the pump chamber 13), air is sufficiently collapsed at a point in time when the pump chamber 13 reaches the discharge port 44 whereby the amount of air remaining in the pump chamber 13 is reduced sufficiently, and therefore, it is possible to restrict the generation of cavitation noise. 1.5 pitches is a lower limit value of the circumferential length LS of the notch portion 43 which enables noise generated by the pump 1 to fall within a permissible range in a test or a simulation performed under predetermined conditions (operating conditions such as air content, pump rotational speed and the like). Consequently, it is possible to restrict the generation of cavitation noise under arbitrary operating conditions.

Figure 8:
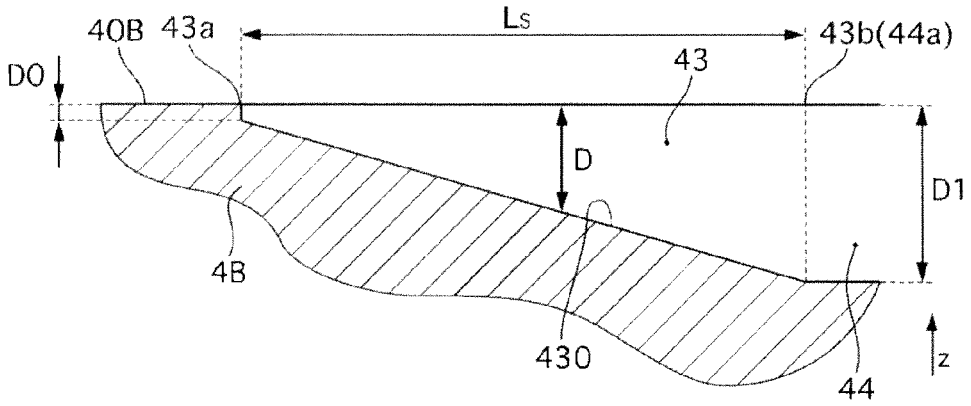
FIG. 8 is a sectional view of a notch portion in the side plate of a first modification resulting from being cut along the circumferential direction.
Figure 9:
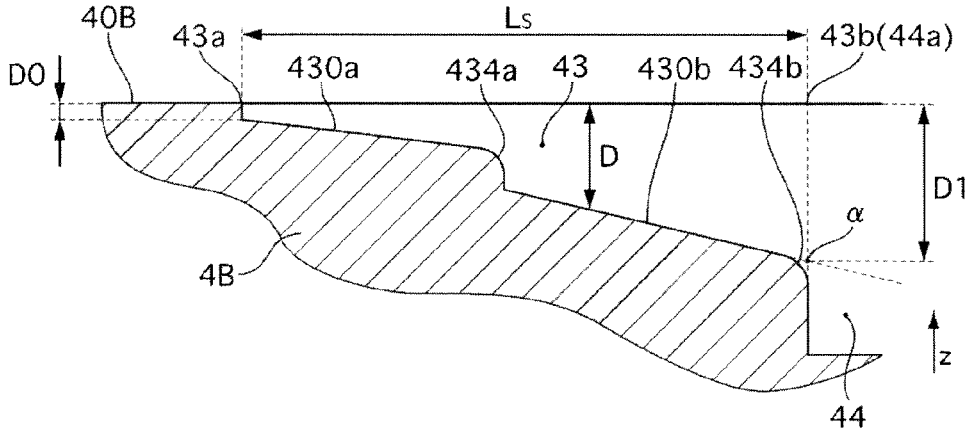
FIG. 9 is a sectional view of a notch portion in the side plate of a second modification resulting from being sectioned along the circumferential direction.

Here, the notch portion 43 is a recess portion formed on the surface 40B of the side plate 4B and represents an area whose sectional area S (resulting from being cut along the plane extending in the radial direction of the rotor 6) is smaller than the sectional area (resulting from being cut along the plane extending in the radial direction of the rotor 6) at the initiating end 44*a* side of the discharge port 44. The discharge port 44 is a recess portion formed on the surface 40B and represents an area to which the discharge hole 441 opens which is a discharge passage to the high pressure chamber. When a configuration is adopted which is different from that of this embodiment and in which no communication hole 442 is provided at the initiating end 44*a* side of the discharge port 44, the notch portion 43 represents, for example, an area shown in FIG. 8 or 9. FIGS. 8 and 9 are sectional views, similar to that shown in FIG. 6, which show modifications of Embodiment 1 with a front body 4C omitted from illustration. FIG. 8 shows a first modification. In the first modification, a depth-wise dimension D1 of a notch portion 43 at a terminating end 43*b* thereof is equal to a depth-wise dimension (a dimension in the direction of the z axis) of a discharge port 44 at an initiating end 44*a* side thereof, and a terminating end 43*b* side of the notch portion 43 continues smoothly to an initiating end 44*a* side of the discharge port 44 (with no step involved therebetween). Note that being similar to the present embodiment, a widthwise dimension W of the notch portion 43 is approximately equal to a widthwise dimension of the discharge port 44. FIG. 9 shows a second modification. In the second modification, a depth-wise dimension D1 of a notch portion 43 at a terminating end 43*b* thereof is smaller than a depth-wise dimension of a discharge port 44 at an initiating end 44*a* side thereof. A terminating end 43*b* side of the notch portion 43 continues to an initiating end 44*a* side of the discharge port 44 with a step 434*b* involved therebetween. The terminating end 43*b* side of the notch portion 43 and the initiating end 44*a* side of the discharge port 44 are bounded by a wall surface of the step 434*b* which extends in the direction of the z axis. Note that being similar to the present embodiment, a widthwise dimension W of the notch portion 43 is approximately equal to a widthwise dimension of the discharge port 44.

In the second modification, in addition to the step 434 which bounds the initiating end 44*a* side of the discharge port 44 and the terminating end 43*b* of the notch portion 43, a step 434*a* is also provided on the notch portion 43 in a middle position in relation to the circumferential direction. A distance in the z axis (a depth-wise dimension D) between a bottom surface (a flat surface 430*b* on the negative side of the z axis) of the notch portion 43 which lies closer to the terminating end 43*b* side with respect to the step 434*a* and a surface 40B is larger than a distance in the z axis (a depth-wise dimension D) between a bottom surface (a flat surface 430*a* on the negative side of the z axis) which lies closer to an initiating end 43*a* side with respect to the step 434*a* and the surface 40B. Namely, the notch portion 43 should be such that the sectional area S thereof is smaller than the sectional area of the discharge port 44, and the sectional area S may change discontinuously (or in a stepped fashion) in the interior of the notch portion 43. These steps 434*a*, 434*b* are rounded at their corners and have an arc-shaped curved surface when viewed from the radial direction of the rotor 6 (that is, the rounded corners project in the rotating direction of the rotor and towards the positive side of the z axis). In this way, in the case of the terminating end 43*b* side of the notch portion 43 continuing to the initiating end 44*a* side of the discharge port 44 via the curved surface of the step 434*b*, the range of the notch portion 43 may be defined as below. Namely, as shown in FIG. 9, when viewed from the radial direction of the rotor 6, a point of intersection between an extension of the flat surface 430*b* at the terminating end 43*b* side of the notch portion 43 which lies on the negative side of the z axis and an extension of the wall surface (extending in the direction of the z axis) which bounds the notch portion 43 and the discharge port 44 is referred to as α. A circumferential length from α to the initiating end 43*a* is referred to as a circumferential length LS of the notch portion 43. A distance in the direction of the z axis from the surface 40B to α is referred to as a depth-wise dimension D1 of the notch portion 43 at the terminating end 43*b*. Similarly, in the first modification, in the case of the curved surface (which projects towards the negative side of the z axis) being interposed between the bottom surface (the flat surface 430 lying on the negative side of the z axis) of the notch portion 43 and the bottom surface (the flat surface lying on the negative side of the z axis) of the discharge port 44, the range of the notch portion 43 may be defined based on a point of intersection between extensions of the two bottom surfaces.

The cam ring control mechanism 3 (the control valve 30) decreases the eccentricity δ of the cam ring 8 as the rotational speed of the pump 1 increases. The circumferential length of the notch portion 43 remains 1.5 pitches or larger even when the eccentricity δ becomes the smallest. Consequently, it is possible to restrict the generation of cavitation noise more effectively. Namely, the rotational speed of the pump 1 is faster when the eccentricity δ is small than when the eccentricity δ is large, and therefore, the time during which the pump chamber 13 (the vane 7) passes by the notch portion 43 becomes short. In other words, the time during which air within the pump chamber 13 is collapsed by the working fluid which flows thereinto becomes short. This increases the fear that cavitation noise is generated. In contrast with this, the time during which the pump chamber 13 passes by the notch portion 43 is secured by ensuring that the circumferential length of the notch portion 43 is 1.5 pitches or larger, whereby the generation of cavitation noise can be restricted. Note that there is imposed no specific limitation on the shape of the notch portion 43 as long as the circumferential length LS of the notch portion 43 is 1.5 pitches or larger. For example, the sectional area S of the notch portion 43 may be constant in the circumferential direction or may be smaller at the terminating end 43*b* side than at the initiating end 43*a* side. Additionally, the dimension of the notch portion 43 in the direction of the z axis (the depth-wide dimension D) may be constant, and the dimension of the notch portion 43 in the radial direction of the rotor (the widthwise dimension W) may not be constant.

As has been described above, the working fluid is introduced from the side of the discharge port 44 where the pressure is high into the pump chamber 13 which communicates with the notch portion 43 by way of a gap defined between the vane 7 which makes up the pump chamber 13 and lies to face the rotating direction of the rotor (the end portion of the vane 7 including the lateral surface 74 thereof) and the notch portion 43 (the bottom surface 430 and the lateral surfaces 431, 432 of the notch portion 43). As this occurs, there are fears that air is produced further as a result of a drop in pressure in the flow (flow path) of working fluid passing through the gap. Here, there is a tendency that a difference in pressure between two pump chambers 13 which hold the vane 7 passing by the initiating end 43*a* side of the notch portion 43 therebetween is larger than a difference in pressure between two pump chambers 13 which hold the vane 7 passing by the terminating end 43*b* side of the notch portion 43. Consequently, the flow velocity in the flow path is faster at the initiating end 43*a* side than at the terminating end 43*b* side of the notch portion 43, and air tends to be produced further as a result of a drop in pressure. In contrast with this, with the pump 1 of this embodiment, the sectional area S at the terminating end 43*b* side is larger than the sectional area S at the initiating end 43*a* side of the notch portion 43. Namely, the sectional area of the flow path is smaller at the initiating side 43*a* side than at the terminating end 43*b* side of the notch portion 43. Consequently, the viscous resistance (resistance that the working fluid as a hydraulic fluid receives from the wall surface 430 which makes up the flow path and the like due to the viscosity of the working fluid) becomes larger at the initiating end 43*a*, and therefore, the flow velocity becomes slower even under the same discharge pressure. This restricts the aforesaid drop in pressure. As a result, a further generation of air is restricted which would otherwise be triggered by the drop in pressure. Consequently, the amount of air remaining in the pump chamber 13 is reduced by the time when the pump chamber 13 reaches (communicates with) the discharge port 44, whereby it is possible to restrict the generation of cavitation noise more effectively.

In particular, the pressure difference becomes the largest between the pump chamber 13 which is defined in the rotating direction of the rotor 6 by the vane 7 which passes by the initiating end 43*a* of the notch portion 43 (overlaps the notch portion 43 near the initiating end 43*a*) and the pump chamber 13 which is defined in the reverse rotating direction of the rotor 6 by the same vane 7. Consequently, the flow velocity in the flow path becomes faster near the initiating end 43*a* than at portions other than the portion near the initiating end 43*a* of the notch portion 43 even under the same discharge pressure. Consequently, air tends to be produced further in the pump chamber 13 by a drop in pressure. In contrast with this, with the pump 1 of this embodiment, the notch portion 43 is formed through machining so that the depth-wise dimension D0 at the initiating end 43*a* is 0.06 mm or smaller. This can increase the cavitation noise restricting effect which results from increasing the viscous resistance in the way described above. Namely, firstly, the accuracy of the circumferential length of the notch portion 43 can be improved by forming the notch portion 43 through machining. However, in the event that the notch portion 43 is formed through machining, as shown in FIG. 6, a step is produced between the surface 40B and the notch portion 43 at a distal end thereof (the initiating end 43*a* which is opposite to the terminating end 43*b* which connects to the discharge port 44). In other words, the initiating end 43*a* is formed into the stepped shape to provide the accuracy with which the distal end (the initiating end 43*a*) of the notch portion 43 is positioned. With the pump 1 of this embodiment, the depth of this step (the depth-wise dimension D0 at the initiating end 43*a*) is 0.06 mm or smaller. This reduces the sectional area of the flow path (the gap defined between the vane 7 near the initiating end 43*a* and the notch portion 43), and therefore, the viscous resistance in the flow path becomes large. Consequently, the flow velocity becomes slow when the working fluid is introduced from the discharge port 44 into the pump chamber 13 via the flow path (the gap). (Namely, the increase in flow velocity due to the large pressure difference is restricted by the increase in viscous resistance.) This can restrict the drop in pressure described above. As a result, it is possible to restrict the generation of cavitation noise more effectively.

On the other hand, a small pressure difference is produced between the pump chamber 13 which is defined on the rotating direction side of the rotor 6 by the vane 7 which passes by the terminating end 43*b* side of the notch portion 43 and the pump chamber 13 which is defined on the reverse rotating direction side of the rotor 6 by the same vane 7. Consequently, the flow velocity in the flow path is slow, and therefore, there are few fears that air is produced further in the pump chamber 13 by the drop in pressure described above. In contrast with this, with the pump 1 of this embodiment, the sectional area of the flow path is larger at the terminating end 43*b* side than at the initiating end 43*a* side. Consequently, the viscous resistance becomes small, and therefore, the flow velocity becomes fast even with the same pressure difference. (Namely, the reduction in flow velocity by the small pressure difference is restricted by the reduction in viscous resistance.) This enables the working fluid to be introduced from the discharge port 44 side into the pump chamber 13 via the notch portion 43 more quickly at the terminating end 43*b* side of the notch portion 43. Consequently, the amount of air remaining in the pump chamber 13 is reduced by the time when the pump chamber 13 reaches the discharge port 44, whereby it is possible to restrict the generation of cavitation noise more effectively. There is imposed no specific limitation on the shape of the notch portion 43 as long as the sectional area S of the notch portion 43 is larger at the terminating end 43*b* than at the initiating end 43*a*. For example, the notch portion 43 may be formed into such a shape, for example, that the dimension in the radial direction of the rotor (the widthwise dimension W) decreases gradually as the notch portion 43 extends from the terminating end 43*b* side to the initiating end 43*a* side of the notch portion 43 (the similar shape to the notch portion 420 of the suction port 42). In this case, the notch portion 43 may be formed through machining so that the widthwise dimension W at the initiating end 43*a* becomes 0.06 mm or smaller. By doing so, as with the configuration described above, the viscous resistance near the initiating end 43*a* of the notch portion 43 can be increased, whereby it is possible to restrict the generation of cavitation noise more effectively.

In addition, as with the second modification shown in FIG. 9, the sectional area S may change discontinuously in the circumferential direction. In this embodiment, being different from the second modification, the notch portion 43 is formed so that the sectional area S of the notch portion 43 increases gradually from the initiating end 43*a* side towards the terminating end 43*b* side. Consequently, the sectional area of the flow path does not change discontinuously (in the stepped fashion) but changes continuously as the rotor 6 rotates. Consequently, a change in pressure in the pump chamber 13 associated with a quick change in sectional area of the flow path can be restricted. Note that in the second modification, the step 434*a* is formed into the rounded shape. This restricts to some extent the sectional area of the flow path from changing quickly even when the vane 7 passes by the portion where the step 434*a* is formed.

As shown in FIG. 7, the end portion of the vane 7 which lies on the negative side of the z axis to be opposite to the notch portion 43 is formed into the rounded shape. This allows a circumferential thickness of the vane 7 to decrease gradually towards the notch portion 43 (the negative side of the z axis) at that end portion. Consequently, it is possible to restrict the generation of cavitation noise more effectively. Namely, when the vane 7 passes by the initiating end 43*a* of the notch portion 43, a gap defined between the surfaces 72, 741 of the end portion of the vane 7 which face the reverse rotating direction of the rotor and the wall surface 433 making up the initiating end 43*a* of the notch portion 43 defines part of the flow path through which the working fluid is introduced into the pump chamber 13 via the notch portion 43. A magnitude of this gap (a distance between the surfaces 72, 741 and the wall surface 433) is referred to as D2. The aforesaid end portion of the vane 7 is formed into the rounded shape in which the circumferential thickness of the vane 7 decreases gradually towards the notch portion 43 (the negative side of the z axis). Therefore, the D2 does not increase drastically from zero as the rotor 6 rotates but increases gradually as the vane 7 moves in the circumferential direction. Consequently, the sectional area of the flow path (the flow path defined between the surfaces 72, 741 and the wall surface 433) near the initiating end 43*a* of the notch portion 43 is restricted from being increased quickly. This restricts an increase in flow velocity, and therefore, as described above, it is possible to restrict a further generation of air in the pump chamber 13 which would otherwise be triggered by a drop in pressure. Additionally, it is possible to restrict a change in pressure in the pump chamber 13 into which the working fluid is supplied via the flow path. In other words, by forming the aforesaid end portion of the vane 7 into the rounded shape, it is possible to obtain a substantially similar throttle effect to one obtained by a configuration in which the bottom surface 430 is made to continue directly to the surface 40B by omitting the step of the wall surface 433 at the initiating end 43*a* of the notch portion 43 (for example, with the aforesaid end portion of the vane 7 kept rectangular without being formed into the rounded shape). Note that the curved surface 742 does not have to be provided on the end portion of the vane 7 which faces the rotating direction of the rotor 6 in order to obtain this function. In this embodiment, not only the curved surface 741 but also the curved surface 742 is provided, the orientation of the vane 7 does not have to be taken into consideration when the vane 7 is assembled to the rotor 6, thereby making it possible to facilitate assembling of the pump 1.

In addition, should the aforesaid end portion of the vane 7 be not formed into the rounded shape described above (should the curved surfaces 741, 742 be not provided on the vane 7), a stagnation point is generated near corner portions of the aforesaid end portion of the vane 7 where the surfaces 72, 74 intersect each other and the surfaces 73, 74 intersect each other when the working fluid flows through the notch portion 43 between the pump chambers 13 which lie adjacent to each other with the vane 7 held therebetween. When such a stagnation point is produced, there are fears that a drop in pressure is caused to trigger a further production of air. In contrast with this, with the pump 1 of this embodiment, the aforesaid end portion of the vane 7 is rounded. This allows the working fluid to flow smoothly near the corner portions of the vane 7, this restricting the stagnation point from being generated. Consequently, it is possible to restrict a further generation of air which would otherwise be triggered by a drop in pressure. Note that when at least one of the curved surfaces 741, 742 is provided, the generation of a stagnation point can be restricted near the portion where the curved surface is provided. In this embodiment, since both of the curved surfaces 741, 742 are provided, it is possible to restrict the generation of a stagnation point more effectively. Additionally, as has been described above, it possible to facilitate assembling of the pump 1.

There is imposed no specific limitation on the sectional shape of the notch portion 43 when cut along a plane which extends in the radial direction of the rotor 6. For example, the sectional shape of the notch portion 43 may be a wedge shape in which a distance between the two wall surfaces 431, 432 which face each other in the radial direction of the rotor 6 increases as the notch portion 43 extends towards an opening portion thereof which lies on the positive side of the z axis. With the pump 1 of this embodiment, the section of the notch portion 43 has a flat shape in which the dimension W in the radial direction of the rotor 6 (the widthwise direction of the notch portion 43) is larger than the depth-wise dimension D. Consequently, compared with other sectional shapes having the same area, the depth-wise dimension D of the gap defined between the vane 7 (the lateral surface 74 of the vane 7) and the notch portion 43 (the wall surface 430 or the like of the notch portion 43) is restricted over a wider range in relation to the radial direction of the rotor 6 on the notch portion 43. Namely, the distance between the surfaces 74, 430 which make up the gap becomes small over the wider range on the notch portion 43. This can increase the viscous resistance against the flow (flow path) of working fluid through the gap as a whole to thereby reduce the flow velocity of the working fluid as a whole (that is, the range where the flow velocity is reduced can be increased in the radial direction of the rotor 6). Consequently, the flow velocity can be reduced effectively by making the sectional shape flat at least at the initiating end 43*a* side of the notch portion 43 (where the flow velocity in the flow path tends to become faster). Because of this, it is possible to restrict a further generation of air more effectively which would otherwise be triggered by a drop in pressure. Thus, it is possible to restrict the generation of cavitation noise more effectively. On the other hand, by securing the size of the sectional area of the flow path as with the other sectional shapes, it is possible to introduce the working fluid from the discharge port 44 side into the pump chamber 13 with good efficiency. Note that the flat shape of the notch portion 43 may be such that the depth-wise dimension D is larger than the dimension W in the radial direction of the rotor 6. In this embodiment, W is larger than D. Thus, the area of the opening which opens from the interior of the notch portion 43 to the pump chamber 13 can be secured larger. Consequently, it is possible to introduce the working fluid from the side of the discharge port 44 into the pump chamber 13 via the notch portion 43 with better efficiency. Additionally, the workability of the notch portion 43 is improved. By making the section of the notch portion 43 rectangular, the workability of the notch portion 43 can be improved more.

A similar notch portion 43 to the notch portion 43 on the side plate 4B is also formed on the front body 4C. The notch portion 43 of the front body 4C has the same configuration as that of the notch portion 43 of the side plate 4B and hence functions in the same way as described heretofore. Note that only one of the two notch portions 43 may be provided. In the pump 1 of this embodiment, the pair of notch portions 43 is provided in such a way as to face each other in the direction of the z axis with the pump chamber 13 held therebetween. Therefore, compared with a configuration in which only one notch portion 43 is provided (only on one of the side plate 4B and the front body 4C), with a total of the sectional areas S of the gaps (the flow paths) defined between the vane 7 and the notch portions 43 remaining the same as in the comparison configuration, the sectional area S of the flow path in each notch portion 43 can be made small (for example, a half the gap in the comparison configuration). Because of this, the viscous resistance in the flow path in each notch portion 43 can be increased while securing the flow rate as a whole at the flow paths in both the notch portions 43. By reducing the sectional area S of the flow path at least at the initiating end 43*a* side of each notch portion 43, it is possible to restrict a further generation of air which would otherwise be triggered by a drop in pressure. Thus, it is possible to restrict the generation of cavitation noise more effectively. Additionally, by securing the total flow rate of the flow paths, it is possible to introduce the working fluid from the discharge port 44 side into the pump chamber 13 via the notch portions 43 with good efficiency. The pressure in the notch portion 43 acts on the surface 74 of the vane 7 which lies in the direction of the z axis and the like. Since the notch portions 43 are provided on both the sides of the z axis with the pump chamber 13 (the vane 7) held therebetween, the pressures in the notch portions 43 act on the vane 7 positioned to stay at both the notch portions 43 on both the surfaces 74, 75 at both the sides in the direction of the z axis. The pressures so acting restrict the vane 7 from being pressed against the side plate 4B or the front body 4C. This can restrict the torque for driving the pump 1 from being increased excessively.

The pair of notch portions 43 can have the circumferential lengths LS, LF which are different from each other. Thus, when regarding the pair of notch portions 43 as a single notch portion 43 as a whole, the characteristics of the flow path which is defined by the single notch portion 43 can easily be tuned. For example, in this embodiment, the circumferential length LF of the notch portion 43 on the front body 4C is shorter than the circumferential length LS of the notch portion 43 on the side plate 4B. In other words, the initiating end 43*a* of the notch portion 43 on the front body 4C lies closer to the rotating direction side of the rotor 6 (the discharge port 44 side) with respect to the initiating end 43*a* of the notch portion on the side plate 4B. Consequently, when regarding the two notch portions 43 as the single notch portion 43 as a whole, compared with a configuration in which the circumferential lengths LS, LF of the two notch portions 43 are made equal to each other (in which the circumferential positions of the initiating ends 43*a* of the two notch portions 43 are made to coincide with each other), the cross section S of the flow path at the initiating end 43*a* side becomes smaller although the circumferential length remains the same. Consequently, the two notch portions 43 as a whole can provide the same characteristics as those provided by the notch portion 43 according to the second modification shown in FIG. 9 (the steps are provided in the circumferential direction) while the notch portions 43 are each given a simple configuration in which no step is formed in the circumferential direction. Note that the circumferential length L of either of the notch portion 43 of the front body 4C and the notch portion 43 of the side plate 4B may be 1.5 pitches or larger. In other words, when regarding the pair of notch portions 43 as the single notch portion 43 as a whole, the circumferential length L thereof may fall within the range described above. Consequently, in this embodiment in which the LS is approximately two pitches (which falls within the range described above), the LF may be smaller than 1.5 pitches.

Figure 10:
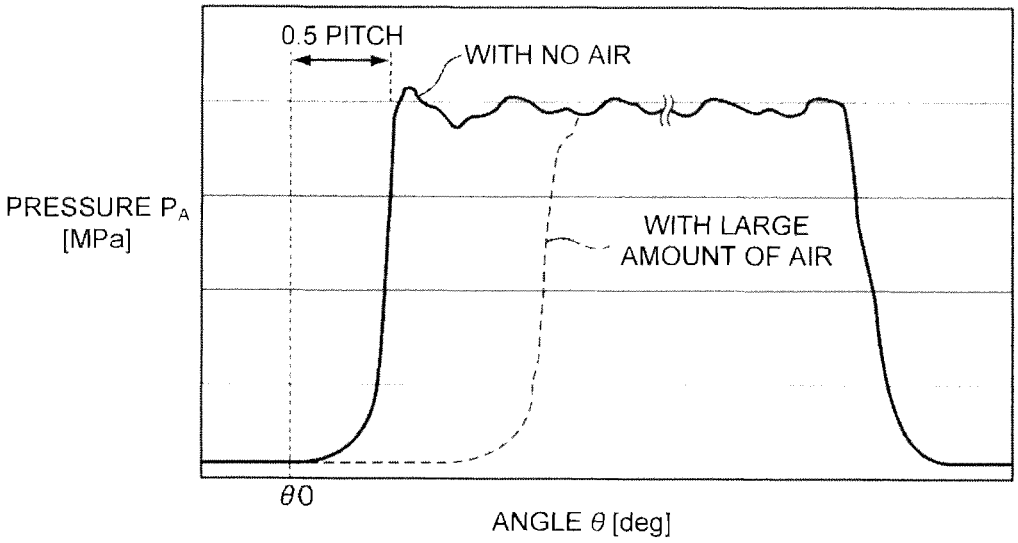
FIG. 10 is a characteristic graph illustrating a change in pressure in a pump chamber with a rotational angle θ of the rotor in Embodiment 1.
Figure 11:
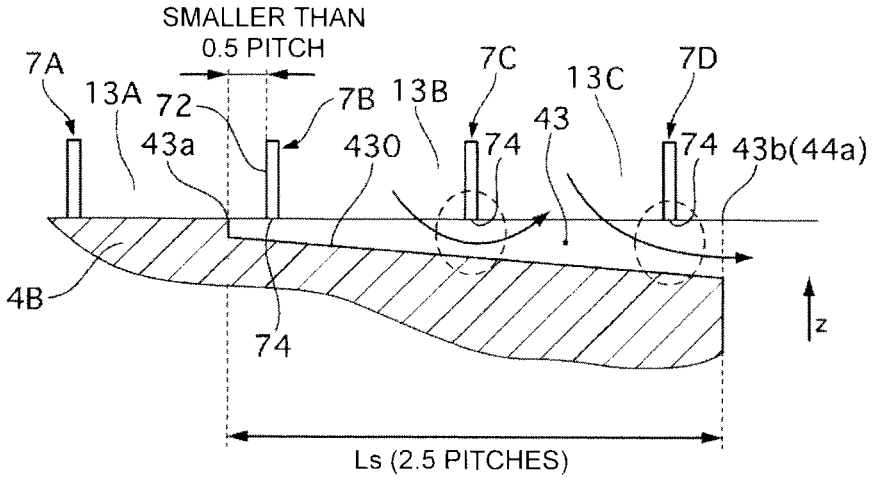
FIG. 11 is a sectional view of the notch portion in the side plate of Embodiment 1 with a circumferential length thereof set, for example, to 2.5 pitches resulting from being sectioned in the circumferential direction, showing a state in which a distance from an initiating end of the notch portion to the vane is smaller than 0.5 pitch.
Figure 12:
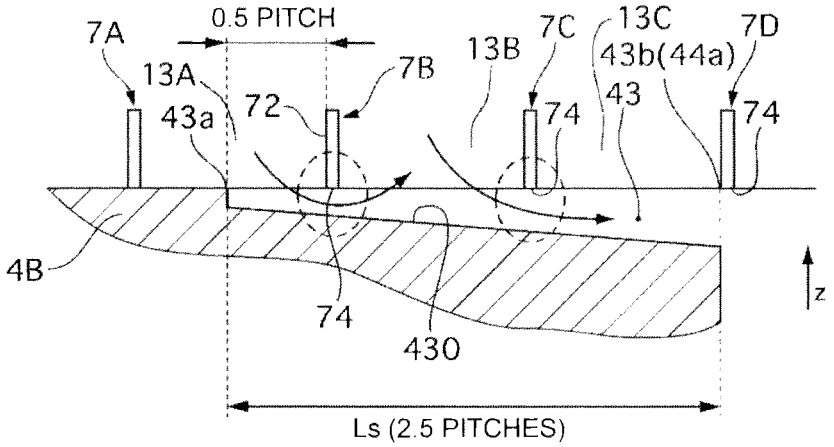
FIG. 12 is a sectional view similar to that in FIG. 11, showing a state in which the distance from the initiating end of the notch portion to the vane is 0.5 pitch.
Figure 13:
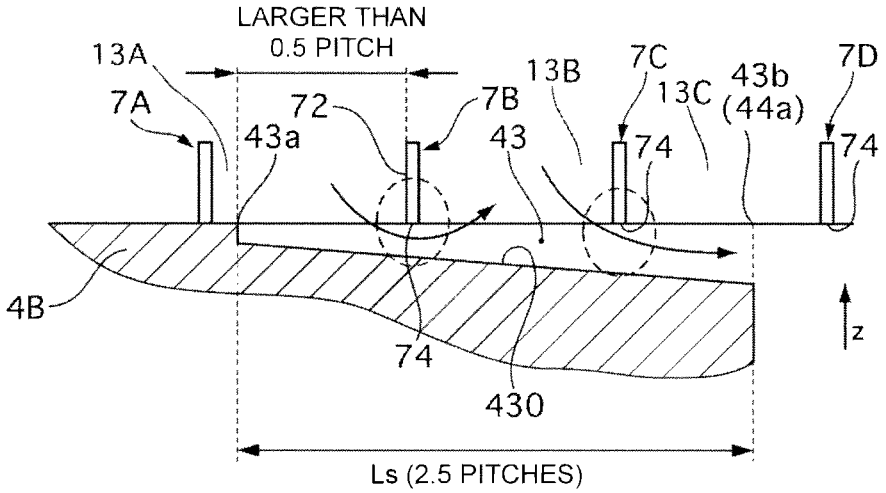
FIG. 13 is a sectional view similar to that in FIG. 11, showing a state in which the distance from the initiating end of the notch portion to the vane is larger than 0.5 pitch.

Returning to the notch portion 43 of the side plate 4B, another function will be described. The circumferential length LS of the notch portion 43 is smaller than 2.5 pitches. Consequently, it is possible to restrict the occurrence of a situation in which the torque for driving the pump 1 (hereinafter, referred to as driving torque) becomes excessive under operating conditions where no air is mixed into the pump chamber 13 (the amount of air is small). Hereinafter, a specific description will be made. A pump chamber 13 which is defined between a certain vane 7A and a vane 7B which lies adjacent to the vane 7A on a side facing the (forward) rotating direction of the rotor 6 will be referred to as a pump chamber 13A. FIG. 10 is a characteristic diagram showing how a pressure PA in the pump chamber 13A changes with rotational angle θ of the rotor 6 since the pump chamber 13A starts to communicate with the notch portion 43. A solid line illustrates a change in pressure PA when no air is mixed into the pump chamber 13A (the amount of air is small). A dotted line illustrates a change in pressure PA when air is mixed into the pump chamber 13A (the amount of air is large). FIGS. 11 to 13 are sectional views similar to FIG. 6 with the front body 4C omitted from illustration, and in these figures, the circumferential length LS of the notch portion 43 is illustrated as being 2.5 pitches, for example. FIGS. 11 to 13 show schematically individual states in which vanes 7A to 7D move in one circumferential direction (from the initiating end 43*a* side to the terminating end 43*b* side of the notch portion 43) as the rotor 6 rotates. FIG. 11 shows a state in which a distance from the initiating end 43*a* of the notch portion 43 to a surface 72 of the vane 7B which lies to face the reverse rotating direction of the rotor (hereinafter, referred to simply as the vane 7B) is smaller than 0.5 pitch. FIG. 12 shows a state in which the distance is 0.5 pitch. FIG. 13 shows a state in which the distance is larger than 0.5 pitch and smaller than one pitch.

The rotating angle θ resulting when the vane 7B is positioned at the initiating end 43*a* of the notch portion 43 will be referred to as θ0. When no air is mixed into the pump chamber 13A, the pressure PA starts to increase gradually as θ increases from θ0. The pressure PA starts to rise seriously (PA increases to the discharging pressure) from where θ advances about 0.5 pitch from θ0. Specifically, when θ is smaller than about 0.5 pitch away from θ0 to stay close to 0 (FIG. 11), the working fluid is introduced from an adjacent pump chamber 13B where the pressure is high into the pump chamber 13A through a gap defined between the notch portion 43 (the wall surface 430 of the notch portion 430 or the like) and the vane 7B (the lateral surface 74 of the vane 7B). Consequently, the pressure in the pump chamber 13A starts to increase gradually from the pressure (the atmospheric pressure) on the suction side. When θ is 0.5 pitch or larger away from θ0 (the circumferential distance from the initiating end 43*a* to the vane 7B is about 0.5 pitch or larger) (FIGS. 12, 13), the displacement of the pump chamber 13A decreases as θ increases. Since no air is mixed into the pump chamber 13A, the pressure PA increases as the displacement decreases in the pump chamber 13A. Consequently, when θ is about 0.5 pitch away from θ0, the PA increases towards the discharging pressure, thereafter the PA is caused to stay near the discharging pressure although θ increases. Consequently, the changing characteristic of PA relative to θ becomes as shown by the solid line shown in FIG. 10. Note that as shown by the dotted line in FIG. 10, when air is mixed into the pump chamber 13A (the amount of air is large), the pressure PA rises later than when no air is mixed into the pump chamber 13A (the amount of air is small). However, as has been described above, since the working fluid is introduced from the discharge port 44 side into the pump chamber 13A via the notch portion 43, the pressure PA rises to the discharging pressure by the time when the pump chamber 13A reaches the initiating end 44*a* of the discharge port 44 (in the example shown in FIG. 10, when θ is about 1.5 pitches away from θ0).

With no air mixed into the pump chamber 13A, when θ is about 1.5 pitches or larger away from θ0, the working fluid in the pump chamber 13A flows out into the adjacent pump chamber 13B through the gap as the displacement of the pump chamber 13A decreases. This will be true with the pump chamber 13B. Since no air is mixed into the pump chamber 13B, the working fluid in the pump chamber 13B flows out into an adjacent pump chamber 13C through the gap of a vane 7C as the displacement of the pump chamber 13B decreases. In FIGS. 12 and 13, the flowing out of the working fluid in the way described above is indicated by arrows, and the gaps through which the working fluid is passing when it flows out in the way described above are indicated as being surrounded by dotted lines. The working fluid introduced into the pump chamber 13C is finally introduced into the discharge port 44 to thereby be discharged from the pump 1 via the discharge hole 441. Namely, when θ is about 1.5 pitches or larger away from θ0, the flowing direction of the working fluid resulting when no air is mixed into the pump chamber 13A (the amount of air is small) becomes opposite to the flowing direction of the working fluid resulting when air is mixed into the pump chamber 13A (the amount of air is large).

The sectional areas of the gaps (that is, the sectional areas S of the notch portion 43) are smaller than the sectional area of the discharge port 44. Consequently, when no air is mixed into the pump chamber 13A (the amount of air is small), the gaps function as throttle portions when the working fluid is discharged from the pump chamber 13 to the discharge port 44 (the discharge hole 441) side via the notch portion 43. In case the flow path resistance at the throttle portions is large, the pressures in the pump chambers 13 rise excessively. This prevents the smooth rotation of the rotor 6, causing fears that the driving torque is increased. In case the notch portion 43 extends long in the circumferential direction, the number of vanes 7 or gaps functioning as the throttle portion which are located within an angular range of this notch portion 43 is increased, and thus, the driving torque is increased accordingly. In contrast with this, with the pump 1 of this embodiment, the circumferential length LS of the notch portion 43 is smaller than 2.5 pitches. As shown in FIGS. 11 to 13, when the LS is 2.5 pitches, for example, the number of gaps functioning as the throttle portion becomes three momentarily in case the gap defined by a vane 7D which is positioned at the terminating end 43*b* of the notch portion 43 (the initiating end 44*a* of the discharge port 44) in the state shown in FIG. 12 is counted as the throttle portion. In the other states, the number of gaps is two or smaller. Consequently, when the LS is two pitches as in this embodiment, the number of gaps functioning as the throttle portion becomes two or smaller (there is a state or a period of time when only one gap exists). Note that in case the LS is 1.5 pitches, the number of gaps is normally one or smaller when excluding the state where the number of gaps becomes two momentarily. Thus, when the notch portion 43 is provided whose circumferential length LS is 1.5 pitches or more, the number of gaps functioning as the throttle portion is not more than two even under the operating conditions where no air is mixed into the pump chamber 13A (the amount air is small). In this way, by reducing the number of gaps functioning as the throttle portion to as small a number as possible, the occurrence of a situation can be restricted where the driving torque becomes excessive. The function which has been described heretofore will be the true with the notch portion 43 on the front body 4C.

Embodiment 2

In a pump 1 of Embodiment 2, there are provided a plurality of vanes 7 which are not disposed evenly or disposed at unequal intervals (pitches) in a circumferential direction. Namely, circumferential distances between vanes 7 which lie adjacent to each other in the circumferential direction (corresponding to angles formed by vanes 7 which lie adjacent to each other) are not equal to each other. Consequently, a circumferential length of a notch portion 43 is specified based on an average of one pitch (a value which is an average of circumferential distances individually defined between vanes 7 which lie adjacent to each other). The average of one pitch can be calculated, for example, by dividing 360 degrees by the number of vanes 7. A circumferential length of the notch portion 43 is set to be 1.5 times or larger and smaller than 2.5 times the average of one pitch. The other configurations of the pump 1 are similar to those the pump of Embodiment 1. In this way, when the vanes 7 are disposed at unequal intervals, by specifying the circumferential length of the notch portion 43 based on regarding the average value of the unequal intervals as one pitch, similar working effects to those of the pump of Embodiment 1 can be obtained.

Embodiment 3

Figure 14:
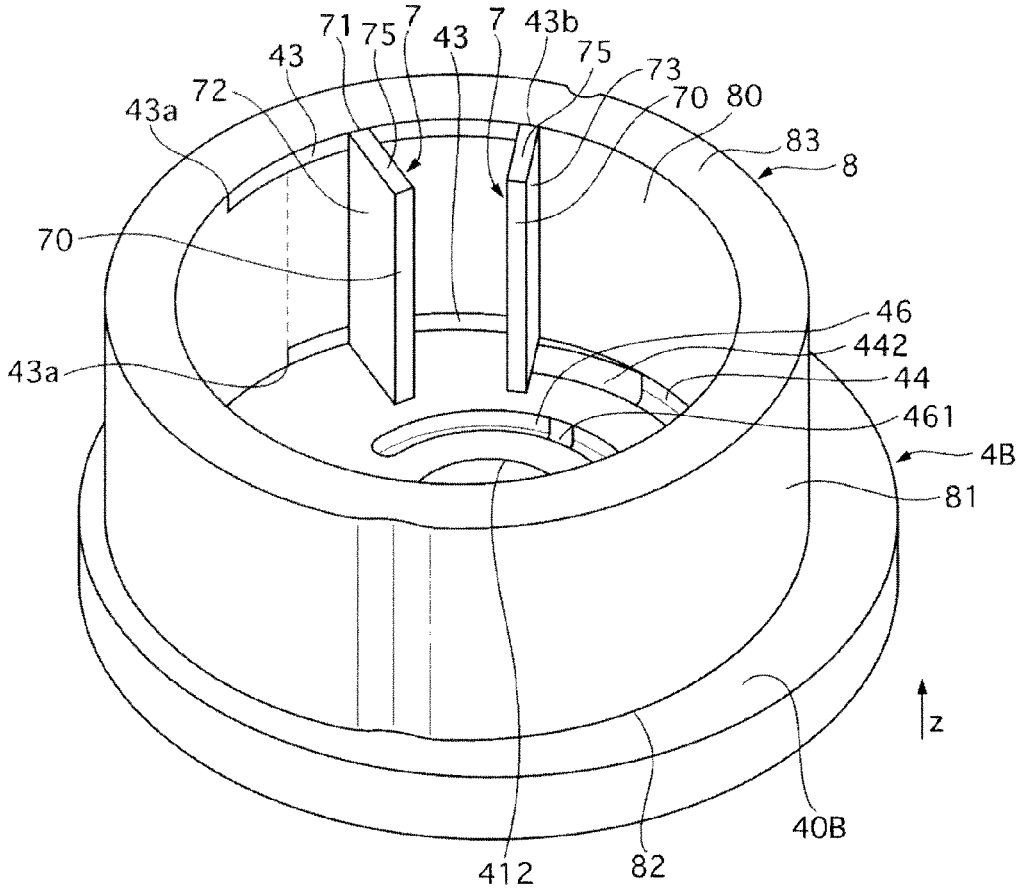
FIG. 14 is a perspective view of a side plate of Embodiment 3 showing a state in which a cam ring and part of vanes are mounted on the side plate.

In a pump 1 of Embodiment 3, a notch portion 43 is provided not on a side plate 4B or a front body 4C but on a cam ring 8. FIG. 14 is a view showing a state in which the cam ring 8 and part of vanes 7 are mounted on the side plate 4B, as viewed obliquely from a positive side of a z axis direction. An inner circumferential surface 80 of the cam ring 8 faces pump chambers 13. A notch portion 43 is provided at each end of the inner circumferential surface 80 in relation to the direction of the z axis.

Firstly, a notch portion 43 on a negative side of the z axis will be described. The notch portion 43 on the negative side of the z axis opens not only to the inner circumferential surface 80 of the cam ring 8 but also to a surface 82 of the cam ring 8 which lies on the negative side of the z axis (or which lies to face a surface 40B of the side plate 4B which lies to face the positive side of the z axis). The notch portion 43 has a flat rectangular sectional shape. Namely, in an arbitrary circumferential position, a dimension of the notch portion 43 in the direction of the z axis (a widthwise dimension) is larger than a dimension of the notch portion 43 in a radial direction of a rotor 6 (a depth-wise dimension). In an arbitrary circumferential position, the widthwise dimension of the notch portion 43 is constant. The depth-wise dimension of the notch portion 43 (a sectional area S of the notch portion 43) is set so as to gradually increase as the notch portion 43 extends from an initiating end 43*a* side towards a terminating end 43*b* side thereof. The depth-wise dimension of the notch portion 43 at the initiating end 43*a* is preferably 0.06 mm or smaller. The notch portion 43 extends in a reverse rotating direction of the rotor 6 from a circumferential position which overlaps an initiating end 44*a* of a discharge port 44 in the radial direction of the rotor 6. Namely, the terminating end 43*b* of the notch portion 43 is provided so as to be located approximately in the same circumferential position as the initiating end 44*a* of the discharge port 44 or closer to a (forward) rotating direction of the rotor 6 with respect to the initiating end 44*a* of the discharge port 44, regardless of the magnitude of an eccentric amount or eccentricity δ of the cam ring 8. The circumferential length of the notch portion 43 (a circumferential length from the initiating end 43*a* of the notch portion 43 to the initiating end 44*a* of the discharge port 44) is set to be 1.5 pitches or larger and smaller than 2.5 pitches. Specifically, the circumferential length of the notch portion 43 is set to be about 1.5 pitches, regardless of the magnitude of the eccentricity δ.

The notch portion 43 on the positive side of the z axis opens not only to the inner circumferential surface 80 of the cam ring 8 but also to a surface 83 of the cam ring 8 which lies on a positive side of the z axis (or which lies to face a surface 40C of the front body 4C which lies to face the negative side of the z axis). The notch portions 43 are formed so that circumferential length of the notch portion 43 on the positive side of the z axis and the circumferential length of the notch portion 43 on the negative side of the z axis are different from each other. Specifically, the circumferential length of the notch portion 43 on the positive side of the z axis is set to be approximately two pitches, regardless of the magnitude of the eccentricity δ. A depth-wise dimension of the notch portion 43 on the positive side of the z axis at a terminating end 43*b* thereof may differ from a depth-wise dimension of the notch portion 43 on the negative side of the z axis at the terminating end 43*b* thereof. The other shape, size, and range of the notch portion 43 on the positive side of the z axis are similar to those of the notch portion 43 on the negative side of the z axis. An end portion of the vane 7 which lies radially outward of the rotor 6 (that is, an end portion which faces the inner circumferential surface 80 of the cam ring 8) is formed into a rounded shape by rounding corners thereof. At the end portion (the portion where curved surfaces are provided) of the vane 7, a circumferential thickness of the vane 7 gradually decreases towards a radially outer side of the rotor 6. The other configurations of the pump 1 are similar to those of the pump of Embodiment 1.

Due to the notch portions 43 and the vanes 7 being configured in the way described above, the pump of this embodiment can provide similar working effects to those provided by the pump of Embodiment 1. Note that the notch portions 43 do not have to open to the surfaces 82, 83 of the cam ring 8 which are oriented in the direction of the z axis. For example, a notch portion 43 may be formed on the inner circumferential surface 80 of the cam ring 8 in a position spaced apart a predetermined distance from each end of the inner circumferential surface 80 in the direction of the z axis so as to extend in the circumferential direction. As this occurs, too, a plurality of notch portions 43 may be provided in such a way that their circumferential lengths differ from each other.

Additionally, a notch portion 43 may be provided on either of the surfaces 82, 83 of the cam ring 8 which are oriented in the direction of the z axis. For example, a notch portion 43 opens to the surface 82. This notch portion 43 is provided on an inner circumferential side of the cam ring 8 (so as to extend along an inner circumferential edge of the cam ring 8) and also opens to the inner circumferential surface 80. The notch portion 43 has a flat rectangular sectional shape. Namely, in an arbitrary circumferential position, a dimension of the notch portion in relation to the radial direction of the rotor 6 (a widthwise dimension) is larger than a dimension of the notch portion 43 in relation to the direction of the z axis (a depth-wise dimension). In an arbitrary circumferential position, the widthwise dimension of the notch portion 43 is constant. The depth-wise dimension of the notch portion 43 is set so as to gradually increase from an initiating end 43*a* side towards a terminating end 43*b* side of the notch portion 43. The other shape, size and range of the notch portion 43 are similar to those of the notch portion 43 of this embodiment. In this way, the notch portion 43 may be a flow path which is formed on the surface 82 of the cam ring 8 which lies to face the discharge port 44 (the surface 40B of the side plate 4B which lies on the positive side of the z axis). As this occurs, too, notch portions 43 may be provided on both the surfaces 82, 83 in such a way that their circumferential lengths differ from each other.

Those configurations described above can also provide similar working effects to those of the pump of Embodiment 1. In this embodiment, as with Embodiment 2, distances between the adjacent vanes 7 may be unequal to each other, and as this occurs, by taking one pitch as an average value of these unequal distances, working effects similar to those of Embodiment 2 can be provided.

Other Embodiments

Thus, while the vane pump of some embodiments of the invention has been described, the specific configurations of the invention are not limited by the embodiments, and in case design changes are made without departing from the spirit and scope of the invention, the resulting changes are included in the invention. For example, the invention may be applied to any vane pump, provided that air is mixed into the working fluid under the environment where it is used. Thus, the vane pump of the invention may be used as a hydraulic pressure supply source for a hydraulic actuator other than the automatic transmission. The configuration of any of the notch portions of embodiments of the invention can also be applied not only to the variable displacement vane pump but also to a fixed displacement vane pump. The slots (and vanes) of the vane pump may not extend in the radial direction of the rotor and hence may be angled relative to the radial direction of the rotor.

The invention can also be realized as the following embodiments.

Embodiment (1)

A variable displacement vane pump includes a pump housing including a pump element accommodating portion, a drive shaft supported rotatably on the pump housing, and a rotor provided in the pump housing. The rotor is configured to be driven to rotate by the drive shaft and includes a plurality of slots in a circumferential direction. The variable displacement vane pump further includes a plurality of vanes provided so as to appear from and disappear into the slots, and a cam ring provided movably within the pump element accommodating portion. The cam ring is formed into an annular shape and defines a plurality of pump chambers on an inner circumferential side together with the rotor and the vanes. The variable displacement vane pump further includes a suction port formed in the pump housing. The suction port opens to a suction area of the plurality of pump chambers, in which area a displacement is increased as the rotor rotates. The variable displacement vane pump further includes a discharge port formed in the pump housing. The discharge port opens to a discharge area of the plurality of pump chambers, in which area a displacement is reduced as the rotor rotates. The variable displacement vane pump further includes a cam ring control mechanism (a control valve, first and second fluid chambers and the like) provided in the pump housing and configured to control an eccentricity of the cam ring relative to the rotor, and a notch portion which is a flow path provided to extend from an initiating end of the discharge port towards a terminating end side of the suction port. The notch portion is formed so that a sectional area of the flow path is smaller than a sectional area of the discharge port at the initiating end thereof and that a length of the flow path in a circumferential direction is 1.5 pitches or larger. The terminating end of the suction port is a point where the vane in the suction area last overlaps the suction port. The initiating end of the discharge port is a point where the vane departed from the suction area first overlaps the discharge port. The circumferential direction is a rotating direction of the drive shaft. One pitch is a distance defied in the circumferential direction between adjacent vanes of the plurality of vanes. According to Embodiment (1), the notch portion is set to be 1.5 pitches or larger in circumferential length, whereby it is possible to secure a time long enough for air contained in the hydraulic fluid to be collapsed by the highly pressurized hydraulic fluid which flows in reversely from the discharge port via the notch portion. As a result of this, it is possible to restrict the generation of cavitation noise.

Embodiment (2)

In the variable displacement vane pump according to Embodiment (1), the notch portion is formed so that a length of the notch portion in the circumferential direction is smaller than 2.5 pitches. According to Embodiment (2), the pressure starts to rise from when the pump chamber defined between the adjacent vanes advances 0.5 pitch since the pump chamber has started to communicate with the notch portion. When this pressure is discharged to the discharge port via a gap (which functions as a throttle portion) defined between the notch portion and the vane, in case the length of the notch portion is smaller than 2.5 pitches, the number of throttle portions becomes two, whereby the driving torque can be restricted from being increased excessively. (The number of throttle portions increases as the notch portion extends longer, which leads to an increase in driving torque accordingly.)

Embodiment (3)

In the variable displacement vane pump according to Embodiment (1), the notch portion is formed so that a length in the circumferential direction is 1.5 pitches or larger when the eccentricity of the cam ring relative to the rotor is the smallest. According to Embodiment (3), when the eccentricity of the cam ring is small, the rotational speed of the pump is fast, and the time spent in collapsing air becomes short. Therefore, by ensuring that the notch portion has the length of 1.5 pitches or larger, it is possible to restrict the generation of cavitation noise.

Embodiment (4)

In the variable displacement vane pump according to Embodiment (1), the notch portion is formed so that in the circumferential direction, the sectional area of the flow path is larger at the initiating end side of the discharge port than at the terminating end side of the suction port. According to Embodiment (4), the sectional area of the flow path is reduced at the terminating end side of the suction port to increase the viscous resistance, whereby the flow velocity is dropped to thereby restrict a drop in pressure. As a result of this, it is possible to restrict the generation of cavitation.

Embodiment (5)

In the variable displacement vane pump according to Embodiment (4), the notch portion is formed so that in the circumferential direction, the sectional area of the flow path gradually increases from the terminating end side of the suction port towards the initiating end side of the discharge port. According to Embodiment (5), it is possible to restrict a change in pressure associated with a quick change in sectional area of the flow path.

Embodiment (6)

In the variable displacement vane pump according to Embodiment 4, the notch portion is formed through machining so that a depth at an end portion which lies at the terminating end side of the suction port is 0.06 mm or smaller. According to Embodiment (6), the accuracy of the circumferential length of the notch portion can be improved by forming the notch portion through machining. When the notch portion is formed through machining, although a step is formed at a distal end of the notch portion, by setting the depth of the notch portion at the step portion to 0.06 mm or smaller, the viscous resistance at the distal end of the notch portion is increased, which drops the flow velocity, thereby making it possible to restrict a drop in pressure. As a result of this, it is possible to restrict the generation of cavitation noise. At the distal end of the notch portion, the difference in pressure becomes large, and the flow velocity becomes fast. This increases the cavitation noise reduction effect associated with an increase in viscous resistance.

Embodiment (7)

In the variable displacement vane pump according to Embodiment (1), the notch portion is formed so that the flow path has a flat sectional shape in which a radial dimension relative to a rotational axis of the rotor is larger than a depth-wise dimension. According to Embodiment (7), it is possible to secure the viscous resistance at the notch portion while securing the sectional area of the flow path.

Embodiment (8)

In the variable displacement vane pump according to Embodiment (1), the plurality of vanes are formed into a rounded shape in which a thickness of the vane in the circumferential direction gradually decreases towards the notch portion side at an end portion thereof which lies on a side facing the notch portion. According to Embodiment (8), a similar throttle effect to one provided by the notch portion can be generated by the rounded shape.

Embodiment (9)

In the variable displacement vane pump according to Embodiment (1), the notch portion includes a pair of notch portions provided so as to face each other in the direction of the rotational axis of the rotor with the pump chamber held therebetween. According to Embodiment (9), compared with a case where only one notch portion is provided, with the same flow rate, the sectional area of the flow path can be halved, and therefore, it is possible to increase the viscous resistance while securing the sectional area of the flow path.

Embodiment (10)

In the variable displacement vane pump according to Embodiment (9), the pair of notch portions is formed so that lengths thereof in the circumferential direction differ from each other. According to Embodiment (10), the characteristic of the notch portion can be turned easily.

Embodiment (11)

A variable displacement vane pump includes a pump housing including a pump element accommodating portion, a drive shaft supported rotatably on the pump housing, and a rotor provided in the pump housing. The rotor is configured to be driven to rotate by the drive shaft and includes a plurality of slots in a circumferential direction. The variable displacement vane pump further includes a plurality of vanes provided so as to appear from and disappear into the slots; and a cam ring provided movably within the pump element accommodating portion. The cam ring is formed into an annular shape and defines a plurality of pump chambers on an inner circumferential side together with the rotor and the vanes. The variable displacement vane pump further includes a suction port formed in the pump housing. The suction port opens to a suction area of the plurality of pump chambers, in which area a displacement is increased as the rotor rotates. The variable displacement vane pump further includes a discharge port formed in the pump housing. The discharge port opens to a discharge area of the plurality of pump chambers, in which area a displacement is reduced as the rotor rotates. The variable displacement vane pump further includes a cam ring control mechanism (a control valve, first and second fluid chambers and the like) provided in the pump housing and configured to control an eccentricity of the cam ring relative to the rotor, and a notch portion which is a flow path formed on a surface of the cam ring which lies on a side facing the discharge port. The notch portion is formed so as to extend from a position which faces an initiating end of the discharge port towards a terminating end side of the suction port. The notch portion is formed so that a sectional area of the flow path is smaller than a sectional area of the discharge port at the initiating end thereof and that a length of the flow path in the circumferential direction is 1.5 pitches or larger. The terminating end of the suction port is a point where the vane in the suction area last overlaps the suction port. The initiating end of the discharge port is a point where the vane departed from the suction area first overlaps the discharge port. The circumferential direction is a rotating direction of the drive shaft. One pitch is a distance defied in the circumferential direction between adjacent vanes of the plurality of vanes. According to Embodiment (11), the notch portion is set to be 1.5 pitches or larger in circumferential length, whereby it is possible to secure a time long enough for air contained in the hydraulic fluid to be collapsed by the highly pressurized hydraulic fluid which flows in reversely from the discharge port via the notch portion. As a result of this, it is possible to restrict the generation of cavitation noise.

Embodiment (12)

In the variable displacement vane pump according to Embodiment (11), the notch portion is formed so that a length of the notch portion in the circumferential direction is smaller than 2.5 pitches. According to Embodiment (12), the pressure starts to rise from when the pump chamber defined between the adjacent vanes advances 0.5 pitch since the pump chamber has started to communicate with the notch portion. When this pressure is discharged to the discharge port via a gap (which functions as a throttle portion) defined between the notch portion and the vane, in case the length of the notch portion is smaller than 2.5 pitches, the number of throttle portions becomes two, whereby the driving torque can be restricted from being increased excessively. (The number of throttle portions increases as the notch portion extends longer, which leads to an increase in driving torque accordingly.)

Embodiment (13)

In the variable displacement vane pump according to Embodiment (11), the notch portion is formed so that in the circumferential direction, the sectional area of the flow path is larger at the initiating end side of the discharge port than at the terminating end side of the suction port. According to Embodiment (13), the sectional area of the flow path is reduced at the terminating end side of the suction port to increase the viscous resistance, whereby the flow velocity is dropped to thereby restrict a drop in pressure. As a result of this, it is possible to restrict the generation of cavitation.

Embodiment (14)

In the variable displacement vane pump according to Embodiment (13), the notch portion is formed so that in the circumferential direction, the sectional area of the flow path gradually increases from the terminating end side of the suction port towards the initiating end side of the discharge port. According to Embodiment (14), it is possible to restrict a change in pressure associated with a quick change in sectional area of the flow path.

Embodiment (15)

In the variable displacement vane pump according to Embodiment (13), the notch portion is formed through machining so that a depth at an end portion which lies at the terminating end side of the suction port is 0.06 mm or smaller. According to Embodiment (15), the accuracy of the circumferential length of the notch portion can be improved by forming the notch portion through machining. When the notch portion is formed through machining, although a step is formed at a distal end of the notch portion, by setting the depth of the notch portion at the step portion to 0.06 mm or smaller, the viscous resistance at the distal end of the notch portion is increased, which drops the flow velocity, thereby making it possible to restrict a drop in pressure. As a result of this, it is possible to restrict the generation of cavitation noise. At the distal end of the notch portion, the difference in pressure becomes large, and the flow velocity becomes fast. This increases the cavitation noise reduction effect associated with an increase in viscous resistance.

Embodiment (16)

In the variable displacement vane pump according to Embodiment (11), the plurality of vanes are formed into a rounded shape in which a thickness of the vane in relation to the circumferential direction gradually decreases towards the notch portion side at an end portion thereof which lies on a side facing the notch portion. According to Embodiment (16), a similar throttle effect to one provided by the notch portion can be generated by the rounded shape.

Embodiment (17)

In the variable displacement vane pump according to Embodiment (11), the notch portion is provided at both end sides of the cam ring in the direction of a rotational axis of the rotor, respectively. According to Embodiment (17), compared with a case where only one notch portion is provided, with the same flow rate, the sectional area of the flow path can be halved, and therefore, it is possible to increase the viscous resistance while securing the sectional area of the flow path.

Embodiment (18)

In the variable displacement vane pump according to Embodiment (17), the notch portions provided respectively at both the end sides of the cam ring are formed so that lengths thereof in the circumferential direction differ from each other. According to Embodiment (18), the characteristic of the notch portion can easily be tuned.

Embodiment (19)

A variable displacement vane pump includes a pump housing including a pump element accommodating portion, a drive shaft supported rotatably on the pump housing, and a rotor provided in the pump housing. The rotor is configured to be driven to rotate by the drive shaft and includes a plurality of slots in a circumferential direction. The variable displacement vane pump further includes a plurality of vanes provided so as to appear from and disappear into the slots, and a cam ring provided movably within the pump element accommodating portion. The cam ring is formed into an annular shape and defines a plurality of pump chambers on an inner circumferential side together with the rotor and the vanes. The variable displacement vane pump further includes a suction port formed in the pump housing. The suction port opens to a suction area of the plurality of pump chambers in which area a displacement of is increased as the rotor rotates. The variable displacement vane pump further includes a discharge port formed in the pump housing. The discharge port opens to a discharge area of the plurality of pump chambers, in which area a displacement is reduced as the rotor rotates. The variable displacement vane pump further includes a cam ring control mechanism (a control valve, first and second fluid chambers and the like) provided in the pump housing and configured to control an eccentricity of the cam ring relative to the rotor, and a notch portion which is a flow path provided to extend from an initiating end of the discharge port towards a terminating end side of the suction port. The notch portion is formed so that a sectional area of the flow path is smaller than a sectional area of the discharge port at the initiating end thereof and that a length of the flow path in the circumferential direction is 1.5 pitches or larger. The terminating end of the suction port is a point where the vane in the suction area last overlaps the suction port. The initiating end of the discharge port is a point where the vane departed from the suction area first overlaps the discharge port. The circumferential direction is a rotating direction of the drive shaft. One pitch is an average value of distances defined in the circumferential direction between adjacent vanes of the plurality of vanes. According to Embodiment (19), when the vanes are disposed at unequal intervals, by regarding the average value of the unequal intervals as one pitch, similar working effects to those of the pump of Embodiment 1 can be obtained.

Embodiment (20)

In the variable displacement vane pump according to Embodiment (19), the notch portion is formed so that a length of the notch portion in the circumferential direction is smaller than 2.5 pitches. According to Embodiment (20), the pressure starts to rise from when the pump chamber defined between the adjacent vanes advances 0.5 pitch since the pump chamber has started to communicate with the notch portion. When this pressure is discharged to the discharge port via a gap (which functions as a throttle portion) defined between the notch portion and the vane, in case the length of the notch portion is smaller than 2.5 pitches, the number of throttle portions becomes two, whereby the driving torque can be restricted from being increased excessively. (The number of throttle portions increases as the notch portion extends longer, which leads to an increase in driving torque accordingly.)

The present application claims priority to Japanese Patent Applications No. 2014-192258 filed on Sep. 22, 2014. The entire disclosure of Japanese Patent Application No. 2014-192258 filed on Sep. 22, 2014 including specification, claims, drawings and summary are incorporated herein by reference in its entirety.

What is claimed is:

1. A variable displacement vane pump, comprising:

a pump housing;

a drive shaft supported rotatably on the pump housing;

a rotor provided in the pump housing, the rotor being configured to be driven to rotate by the drive shaft and including a plurality of slots in a circumferential direction;

a plurality of vanes provided so as to appear from and disappear into the slots;

a cam ring provided movably within the pump housing, the cam ring being formed into an annular shape and defining a plurality of pump chambers on an inner circumferential side together with the rotor and the vanes;

a suction port formed in the pump housing, the suction port opening to a suction area of the plurality of pump chambers, in which area a displacement is increased as the rotor rotates;

a discharge port formed in the pump housing, the discharge port opening to a discharge area of the plurality of pump chambers, in which area a displacement is reduced as the rotor rotates;

a control valve provided in the pump housing and configured to control an eccentricity of the cam ring relative to the rotor; and a notch portion which is a flow passageway provided to extend from an initiating end of the discharge port towards a terminating end of the suction port, the notch portion being formed so that a sectional area of the flow passageway is smaller than a sectional area of the discharge port at the initiating end thereof and that a length of the flow passageway in a circumferential direction is 1.5 pitches or larger, wherein the flow passageway is defined by at least one wall of the notch portion, wherein the terminating end of the suction port is a point where a vane in the suction area last overlaps the suction port, the initiating end of the discharge port is a point where a vane departed from the suction area first overlaps the discharge port, the circumferential direction is a rotating direction of the drive shaft, and one pitch is a distance defined in the circumferential direction between adjacent vanes of the plurality of vanes.

2. The variable displacement vane pump according to claim 1, wherein the notch portion is formed so that a length of the notch portion in the circumferential direction is smaller than 2.5 pitches.

3. The variable displacement vane pump according to claim 1, wherein the notch portion is formed so that a length in the circumferential direction is 1.5 pitches or larger when the eccentricity of the cam ring relative to the rotor is the smallest.

4. The variable displacement vane pump according to claim 1, wherein the notch portion is formed so that in the circumferential direction, the sectional area of the flow passageway is larger at an initiating end side of the discharge port than at a terminating end side of the suction port.

5. The variable displacement vane pump according to claim 4, wherein the notch portion is formed so that in the circumferential direction, the sectional area of the flow passageway gradually increases from the terminating end side of the suction port towards the initiating end side of the discharge port.

6. The variable displacement vane pump according to claim 4, wherein the notch portion is machined such that a depth at an end portion which lies at the terminating end side of the suction port is 0.06 mm or smaller.

7. The variable displacement vane pump according to claim 1, wherein the notch portion is formed so that the flow passageway has a flat sectional shape in which a radial dimension relative to a rotational axis of the rotor is larger than a depth-wise dimension.

8. The variable displacement vane pump according to claim 1, wherein the plurality of vanes are formed into a rounded shape in which a thickness of the vane in the circumferential direction gradually decreases towards the notch portion side at an end portion thereof which lies on a side facing the notch portion.

9. The variable displacement vane pump according to claim 1, wherein the notch portion includes a pair of notch portions provided so as to face each other in the direction of a rotational axis of the rotor with a pump chamber of the plurality of pump chambers being held therebetween.

10. The variable displacement vane pump according to claim 9, wherein the pair of notch portions is formed so that lengths thereof in the circumferential direction differ from each other.

11. A variable displacement vane pump, comprising:

a pump housing;

a drive shaft supported rotatably on the pump housing;

a rotor provided in the pump housing, the rotor being configured to be driven to rotate by the drive shaft and including a plurality of slots in a circumferential direction;

a plurality of vanes provided so as to appear from and disappear into the slots;

a cam ring provided movably within the pump housing, the cam ring being formed into an annular shape and defining a plurality of pump chambers on an inner circumferential side together with the rotor and the vanes;

a suction port formed in the pump housing, the suction port opening to a suction area of the plurality of pump chambers, in which area a displacement is increased as the rotor rotates;

a discharge port formed in the pump housing, the discharge port opening to a discharge area of the plurality of pump chambers, in which area a displacement is reduced as the rotor rotates;

a control valve provided in the pump housing and configured to control an eccentricity of the cam ring relative to the rotor; and a notch portion which is a flow passageway formed on a surface of the cam ring which lies on a side facing the discharge port, the notch portion being formed so as to extend from a position which faces an initiating end of the discharge port towards a terminating end of the suction port, the notch portion being formed so that a sectional area of the flow passageway is smaller than a sectional area of the discharge port at the initiating end thereof and that a length of the flow passageway in the circumferential direction is 1.5 pitches or larger, wherein the flow passageway is defined by at least one wall of the notch portion, wherein the terminating end of the suction port is a point where a vane in the suction area last overlaps the suction port, the initiating end of the discharge port is a point where a vane departed from the suction area first overlaps the discharge port, the circumferential direction is a rotating direction of the drive shaft, and one pitch is a distance defined in the circumferential direction between adjacent vanes of the plurality of vanes.

12. The variable displacement vane pump according to claim 11, wherein the notch portion is formed so that a length of the notch portion in the circumferential direction is smaller than 2.5 pitches.

13. The variable displacement vane pump according to claim 11, wherein the notch portion is formed so that in the circumferential direction, the sectional area of the flow passageway is larger at an initiating end side of the discharge port than at a terminating end side of the suction port.

14. The variable displacement vane pump according to claim 13, wherein the notch portion is formed so that in the circumferential direction, the sectional area of the flow passageway gradually increases from the terminating end side of the suction port towards the initiating end side of the discharge port.

15. The variable displacement vane pump according to claim 13, wherein the notch portion is machined such that a depth at an end portion which lies at the terminating end side of the suction port is 0.06 mm or smaller.

16. The variable displacement vane pump according to claim 11, wherein the plurality of vanes are formed into a rounded shape in which a thickness of the vane in the circumferential direction gradually decreases towards the notch portion side at an end portion thereof which lies on a side facing the notch portion.

17. The variable displacement vane pump according to claim 11, wherein the notch portion is provided at both end sides of the cam ring in the direction of a rotational axis of the rotor, respectively.

18. The variable displacement vane pump according to claim 17, wherein notch portions provided respectively at both the end sides of the cam ring are formed so that lengths thereof in the circumferential direction differ from each other.

19. A variable displacement vane pump, comprising:

a pump housing;

a drive shaft supported rotatably on the pump housing;

a rotor provided in the pump housing, the rotor being configured to be driven to rotate by the drive shaft and including a plurality of slots in a circumferential direction;

a plurality of vanes provided so as to appear from and disappear into the slots;

a cam ring provided movably within the pump housing, the cam ring being formed into an annular shape and defining a plurality of pump chambers on an inner circumferential side together with the rotor and the vanes;

a suction port formed in the pump housing, the suction port opening to a suction area of the plurality of pump chambers in which area a displacement of is increased as the rotor rotates;

a discharge port formed in the pump housing, the discharge port opening to a discharge area of the plurality of pump chambers, in which area a displacement is reduced as the rotor rotates;

a control valve provided in the pump housing and configured to control an eccentricity of the cam ring relative to the rotor; and a notch portion which is a flow passageway provided to extend from an initiating end of the discharge port towards a terminating end of the suction port, the notch portion being formed so that a sectional area of the flow passageway is smaller than a sectional area of the discharge port at the initiating end thereof and that a length of the flow passageway in the circumferential direction is 1.5 pitches or larger, wherein the flow passageway is defined by at least one wall of the notch portion, wherein the terminating end of the suction port is a point where a vane in the suction area last overlaps the suction port, the initiating end of the discharge port is a point where a vane departed from the suction area first overlaps the discharge port, the circumferential direction is a rotating direction of the drive shaft, and one pitch is an average value of distances defined in the circumferential direction between adjacent vanes of the plurality of vanes.

20. The variable displacement vane pump according to claim 19, wherein the notch portion is formed so that a length of the notch portion in the circumferential direction is smaller than 2.5 pitches.

* * * * *